US008475000B2

(12) United States Patent
Tamai

(10) Patent No.: US 8,475,000 B2
(45) Date of Patent: Jul. 2, 2013

(54) CONNECTOR, AND LED LIGHTING APPARATUS USING THE CONNECTOR

(75) Inventor: Hideharu Tamai, Kanagawa (JP)

(73) Assignee: Kyocera Elco Corporation (JP)

( * ) Notice: Subject to any disclaimer, the term of this patent is extended or adjusted under 35 U.S.C. 154(b) by 193 days.

(21) Appl. No.: 13/188,936

(22) Filed: Jul. 22, 2011

(65) Prior Publication Data

US 2012/0020088 A1 Jan. 26, 2012

(30) Foreign Application Priority Data

Jul. 23, 2010 (JP) ..... 2010-165821
Dec. 6, 2010 (JP) ..... 2010-271671

(51) Int. Cl.

| | |
|---|---|
| ***F21S 4/00*** | (2006.01) |
| ***F21V 21/005*** | (2006.01) |
| ***H01R 33/94*** | (2006.01) |
| ***H01R 12/91*** | (2011.01) |

(52) U.S. Cl.
USPC ..... 362/249.04; 365/249.02; 365/646; 365/647; 439/65

(58) Field of Classification Search
USPC ..... 362/249.02–249.04, 646, 647, 219, 362/418, 419; 439/61, 65, 74, 81, 82
See application file for complete search history.

(56) References Cited

U.S. PATENT DOCUMENTS

| | | | | |
|---|---|---|---|---|
| 4,932,888 | A * | 6/1990 | Senor | 439/108 |
| 5,337,225 | A * | 8/1994 | Brookman | 362/145 |
| 6,793,369 | B2 * | 9/2004 | Calzaretta et al. | 362/219 |
| 7,547,214 | B2 * | 6/2009 | Duesterhoeft et al. | 439/61 |
| 7,621,655 | B2 * | 11/2009 | Roberts et al. | 362/249.02 |
| 7,682,161 | B2 * | 3/2010 | Mao et al. | 439/74 |
| 8,206,159 | B2 * | 6/2012 | Naito et al. | 439/65 |
| 8,297,788 | B2 * | 10/2012 | Bishop | 362/249.02 |

* cited by examiner

*Primary Examiner* — Alan Cariaso
(74) *Attorney, Agent, or Firm* — McCormick, Paulding & Huber LLP

(57) ABSTRACT

A connector includes a plug connector and a receptacle connector which connect a circuit board to a connecting object and allow relative movement therebetween in a common plane or in mutually parallel planes. The receptacle connector includes a receptacle contact including a pair of holding portions and a pair of guide portions which are spaced from each other with the pair of holding portions positioned therebetween, wherein each guide portion includes a support groove. The plug connector includes a plug contact and a plug insulator which holds the plug contact. The plug contact is linearly elongated and resiliently deformable in a direction of thickness thereof and includes a contact portion that is engaged in the support grooves of the pair of guide portions. The plug insulator includes an opening facing the circuit board, and an accommodation space for accommodating the receptacle contact and the plug contact.

13 Claims, 11 Drawing Sheets

CONNECTOR, AND LED LIGHTING APPARATUS USING THE CONNECTOR

CROSS REFERENCE TO RELATED APPLICATION

The present invention is related to and claims priority of the following co-pending application, namely, Japanese Patent Applications Nos. 2010-165821 filed on Jul. 23, 2010, and 2010-271671 filed on Dec. 6, 2010.

BACKGROUND OF THE INVENTION

1. Field of the Invention

The present invention relates to a connector which connects a circuit board and a connecting object while allowing the circuit board and the connecting object to move relative to each other either in a common plane, in which the circuit board and the connecting object both lie, or in mutually parallel planes, in which the circuit board and the connecting object respectively lie, and relates to an LED lighting apparatus using the aforementioned connector.

2. Description of the Prior Art

Straight tube LED lighting apparatuses (LED lamps) are usually provided with a translucent tube, a plurality of circuit boards and a plurality of connectors. The translucent tube is formed as a linearly elongated hollow cylinder made of glass or plastic (e.g., polycarbonate). The plurality of circuit boards are planar in shape, arranged inside the translucent tube to lie in a common plane and aligned in the lengthwise direction of the translucent tube, and LEDs are fixed to one-side of the surfaces (undersurfaces) of the plurality of circuit boards. The plurality of connectors connect adjacent connectors of the plurality of connectors.

When the plurality of circuit boards are installed in the translucent tube, it is sometimes the case that adjacent circuit boards mutually deviate from their design positions in the aforementioned lengthwise direction or the widthwise direction of the translucent tube (directions orthogonal to the lengthwise direction). Therefore, the aforementioned connectors are required to have the capability of absorbing such positional deviations.

Patent Document 1 (Japanese Unexamined Patent Publication No. 2010-33953) discloses a connector having the capability of absorbing such positional deviations.

This connector is provided with a plurality of receptacle connectors (on-board connectors) which are fixed to one side of the surfaces of a plurality of circuit boards, respectively, and a plurality of plug connectors (coupling connectors), each of which connects two adjacent receptacle connectors of the plurality of receptacle connectors which are fixed to two adjacent circuit boards, respectively.

Each receptacle connector is provided with a receptacle insulator (housing) having an opening on one side thereof (on the opposite side of the receptacle insulator from the associated circuit board side), and a plurality of receptacle contacts (terminals) which are accommodated in the receptacle insulator in a state of facing the opening and which are each electrically connected to a circuit contained on the associated circuit board. Each receptacle contact has a pair of resilient lugs which are spaced from each other and face each other.

Each plug connector is provided with a plug insulator (housing), a plurality of plug contacts (coupling terminals) supported by the plug insulator therein, and an insulating plate which covers a surface of the plug insulator. The plug insulator is provided with a pair of support members and an elastically deformable connecting portion which connects the pair of support members. A plurality of support holes are formed through each of the pair of support members in the direction of thickness thereof. Each plug contact is provided with a linear columnar (prismatic-shaped) connecting portion and a pair of legs which respectively project from both ends of the columnar connecting portion in a direction orthogonal to the columnar connecting portion. One and the other of the pair of legs of each plug contact are inserted into a support hole of one support member of the pair of support members and a support hole of the other support member of the pair of support members from one side so that the end of each leg of each plug contact projects toward the circuit board side from the associated support hole. Each leg of each plug contact is rotatable within a slight angular range about its own axis with respect to the associated support hole, and a rotation of the leg causes the columnar connecting portion of the plug contact to rotate with respect to the associated support member. The insulating plate covers each support member from the opposite side of the pair of legs from the ends thereof to prevent each leg of each plug contact from coming off the associated support hole.

Bringing the pair of support members of each plug connector close to the two receptacle connectors fixed to two adjacent circuit boards, respectively, and inserting the pair of legs of each plug contact into the aforementioned opening of the receptacle insulator cause each leg of each plug contact to enter in between the pair of resilient lugs of the associated receptacle contact to thereby be resiliently held therebetween. As a result, the two adjacent circuit boards are electrically connected to each other via the plug connector and the two receptacle connectors. Therefore, if the connectors disclosed in Patent Document 1 are applied to an LED lighting apparatus such as described above, each circuit board is energized, which causes each LED to emit light.

In addition, if adjacent circuit boards deviate from each other in the lengthwise direction of the LED lighting apparatus from design positions, at least one leg of each plug contact slides with respect to the associated receptacle contact (the associated pair of resilient lugs thereof) while the aforementioned elastically deformable connecting portion is elastically deformed so as to change the distance between the pair of support members to thereby absorb the positional deviation.

On the other hand, if adjacent circuit boards deviate from each other in the widthwise direction of the translucent tube, at least one leg of each plug contact rotates with respect to the associated support hole (the aforementioned columnar connecting portion rotates with respect to the pair of support members) while the aforementioned elastically deformable connecting portion is elastically deformed so as to make the pair of support members slide relative to each other in the widthwise direction of the translucent tube to thereby absorb the positional deviation.

Since the plurality of LEDs and the plurality of connectors are fixed to circuit formation surfaces of the plurality of circuit boards (one side of the surfaces thereof), if the thickness of each connector is increased, the diffusive light that is emitted from the adjacent LEDs is partly intercepted by the connector, which narrows the illumination range (illumination angle) of light emitted from the LEDs. Accordingly, it is desirable that the height (thickness) of each connector be as small as possible.

However, in Patent Document 1, each plug contact has a structure in which the pair of legs of each plug contact project from the associated columnar connecting portion, and hence, the height of each plug contact increases by the amount of this projection.

Additionally, the pair of legs of each plug contact are lower in mechanical strength than the associated columnar connecting portion; however, since the pair of legs of each plug contact are made to contact (to be engaged with) the associated receptacle contact (the pair of resilient lugs thereof) in Patent Document 1, there is a possibility of each leg of each plug contact being distorted or damaged when the pair of legs of each plug contact and the associated receptacle contact are brought into contact with (are connected to) each other with a positional deviation therebetween. In addition, since the connector disclosed in Patent Document 1 is structured such that one or more legs of each plug contact rotate if the associated adjacent circuit boards deviate from each other in the lateral or rotational direction, repetitive positional deviations or vibrations applied to the connector causes the legs of each plug contact and the pair of resilient lugs of the associated receptacle contact to vibrate minutely, which may cause damage to the plating that is applied to the legs or the resilient lugs or makes the contact resistance therebetween easy to fluctuate. Therefore, the contact reliability between each plug contact and the associated receptacle contact easily deteriorates.

In Patent Document 1, since the plug contacts (the columnar connecting portions thereof) are exposed through the clearance between the pair of support members, even though surfaces of the support members of the plug insulator of the plug connector are covered by an insulating plate, there is a possibility of the plug contacts being distorted or sebum (from the hand) of an operator (user) being adhered to the plug contacts when the plug connector is plugged into the receptacle connector. Additionally, the exposure of the plug contacts through the clearance makes it easier for foreign matter such as dust to adhere to the plug contacts, which may become a cause of corrosion of the plug contacts or may cause sparking.

SUMMARY OF THE INVENTION

The present invention provides a connector which connects a circuit board and a connecting object while allowing the circuit board and the connecting object to move relative to each other either in a common plane, in which the circuit board and the connecting object both lie, or in mutually parallel planes, in which the circuit board and the connecting object respectively lie, and which makes it possible to achieve a reduction in height of the connector, an improvement in contact reliability, the protection of contacts and an easy and reliable workability in the engaging operation between the plug and receptacle connectors. The present invention also provides an LED lighting apparatus using this connector.

According to an aspect of the present invention, a connector is provided, including a plug connector and a receptacle connector which are disconnectably connected to each other to connect a circuit board and connecting object to each other in a manner to allow the circuit board and the connecting object to move relative to each other in one of a common plane, in which the circuit board and the connecting object both lie, and in mutually parallel planes, in which the circuit board and the connecting object respectively lie. The receptacle connector includes a receptacle contact which is fixed to one side of the circuit board, the receptacle contact including a pair of holding portions which are resiliently deformable in opposite directions away from each other, and a pair of guide portions which are spaced from each other with the pair of holding portions positioned therebewteen, wherein each guide portion of the pair of guide portions includes a support groove. The plug connector includes a plug contact which is electrically connected to the connecting object, and a plug insulator which holds the plug contact. The plug contact is formed as a plate-shaped member which is linearly elongated in a direction parallel to the plane and resiliently deformable in a direction of thickness of the plate-shaped member, which is held between the pair of holding portions to be movable in the linearly elongated direction, and which includes a contact portion (37) that is engaged in the support grooves of the pair of guide portions. The plug insulator includes an opening on a portion thereof facing the circuit board, and an accommodation space for accommodating the receptacle contact and the plug contact.

It is desirable for the connecting object to include another circuit board which lies in a plane in which the circuit board lies, the receptacle contact being fixed to one of both sides of the another circuit board. The plug contact includes at least two the contact portions, one of which is held between the pair of holding portions and another of which is held between a pair of holding portions on the another circuit board; and a supported portion which lies on a straight line passing through the two contact portions. The plug insulator includes a support portion for supporting the supported portion to allow the supported portion to move in both the linearly elongated direction and the direction of thickness of the plate-shaped member.

It is desirable for the connecting object to include an electric wire which is connected to the plug contact.

It is desirable for the each guide portion of the pair of guide portions to include an engaging projection formed on an inner surface of the support groove. The plug contact includes at least two lock portions with which the engaging projections of the pair of guide portions are engaged when the plug contact is engaged with the support grooves of the pair of guide portions, each of the lock portions being formed as one of a recess and through-hole.

It is desirable for the pair of guide portions to include at least two guide leaves which face each other in a lengthwise direction of the plug contact, and for the support groove to be formed on each of the two guide leaves so that all of the support grooves are aligned in the lengthwise direction of the plug contact.

It is desirable for each of the pair of guide portions to include at least two guide leaves which face each other in a lengthwise direction of said plug contact, and for the engaging projection of each guide portion of the pair of guide portions to include a pair of engaging projections which are respectively formed on both side surfaces on the support groove of at least one of the two guide leaves to be aligned in a direction of thickness of the plug contact.

It is desirable for the receptacle contact to include a base having a flat plate shape which is fixed to the circuit board, wherein each of the pair of guide portions includes a first guide leaf which extends in a direction orthogonal to the base from an end of the base in the lengthwise direction of the plug contact, and a second guide leaf which extends from an end of the first guide leaf toward at least one of the circuit board and the another circuit board. A free end of the second guide leaf is soldered to one of the circuit board and the another circuit board.

It is desirable for one of the pair of holding portions to include an engaging protrusion, and for a connecting hole, in which the engaging protrusion is engaged to be movable relative to the connecting hole in the linearly elongated direction, to be formed in the plug contact.

It is desirable for the other of the pair of holding portions to include a holding protrusion which contacts the plug contact.

It is desirable for a moving range of each of the contact portions in the direction of thickness of the plate-shaped member in the accommodation space to be wider than a moving range of the supported portion with respect to the support portion in the direction of thickness of the plate-shaped member.

In an embodiment, an LED lighting apparatus having more than one the connector and more than one the circuit board is provided, wherein at least one LED being is provided on each the circuit board.

It is desirable for the pair of holding portions to be fixed at different positions in the linearly elongated direction.

According to the present invention, when a positional deviation occurs between the circuit board and the connecting object adjacent to each other in the elongated direction of the plug contact, this positional deviation is absorbed by a slide movement of the contact portion of the plug contact with respect to the pair of holding portions of the receptacle contact in the elongated direction of the plug contact. Therefore, even if a positional deviation occurs between the circuit board and the connecting object adjacent to each other in the elongated direction of the plug contact, the circuit board and the connecting object can be electrically connected to each other with reliability.

In addition, the plug contact is a plate-shaped member elongated in one direction which includes no protrusions extending in directions orthogonal to this one direction, thus having a low-profile structure. Accordingly, this low-profile structure makes it possible to achieve a reduction in height of the entire part of the connector.

Since the plug contact according to the present invention is a substantially straight plate-shaped member having a structure such that the contact portion and the supported portion thereof are aligned, the plug contact has a high mechanical strength against twisting, and the like (compared to a protrusion formed to protrude from a plug contact body). Moreover, stress applied to the plug contact due to a resilient deformation thereof can be effectively dispersed since the plug contact has no bent portion. In addition, since the contact portion, which forms part of the plug contact, is made to be brought in contact with (to be engaged with) the receptacle contact (the pair of holding portions thereof), there is little possibility of the plug contact (the contact portion thereof) being distorted or damaged even if the contact portion of the plug contact and the receptacle contact are brought into contact (engagement)) with each other with a positional deviation therebetween. Accordingly, it is possible to improve the contact reliability between the plug contact and the receptacle contacts.

Additionally, the entire peripheries of the plug contact and the receptacle contact are protected by the circuit board and the plug insulator because the plug contact and the receptacle contact are accommodated in the accommodation space (of the plug insulator) having an opening on a surface thereof facing the circuit board. Accordingly, the plug contact and the receptacle contact can be prevented from being damaged not only when, but also after, the receptacle contact and the plug contact are connected. Moreover, after the receptacle contact and the plug contact are connected, the electrically conductive portions of each connector are all covered, which makes it possible to increase the insulation performance to an extremely high level.

Additionally, the plug contact and the receptacle contact can be engaged with each other easily and securely because an engagement of the contact portion of the plug contact in the support grooves of the pair of guide portions causes the contact portion to be guided to a position to be held between the pair of holding portions when the plug contact and the receptacle contact are engaged with each other.

BRIEF DESCRIPTION OF THE DRAWINGS

The present invention will be discussed below in detail with reference to the accompanying drawings, in which.

DESCRIPTION OF THE PREFERRED EMBODIMENTS

Figure 1:
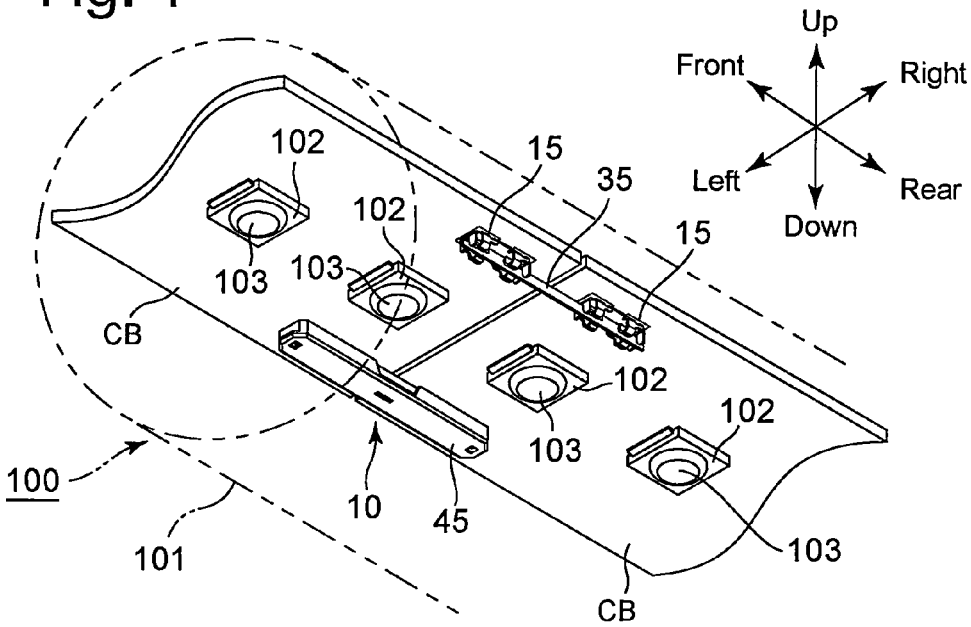
FIG. 1 is a bottom perspective view of a portion of a first embodiment of a straight tube LED lighting apparatus, according to the present invention, with one of a pair of plug insulators removed for clarity.
Figure 2:
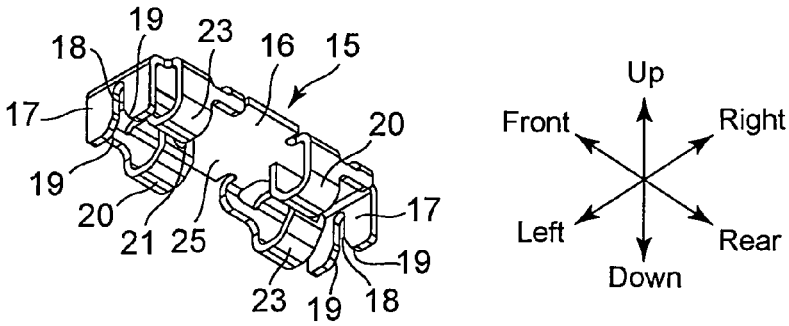
FIG. 2 is a bottom perspective view of a receptacle contact shown in FIG. 1.
Figure 3:
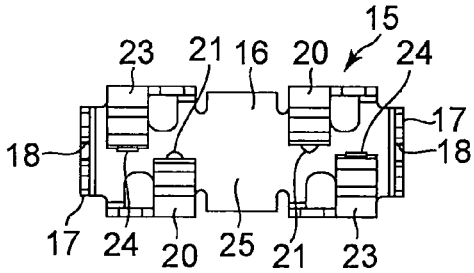
FIG. 3 is a bottom plan view of the receptacle contact.
Figure 4:
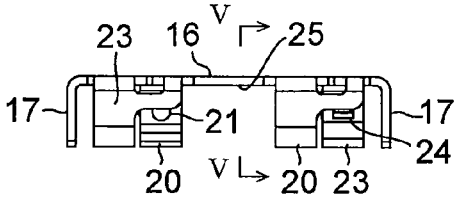
FIG. 4 is a side view of the receptacle contact.

A first embodiment of a straight tube LED lighting apparatus according to the present invention will be hereinafter discussed with reference to FIGS. 1 through 16. In the following descriptions, forward and rearward directions, leftward and rightward directions, and upward and downward directions (vertical direction) of the LED lighting apparatus are determined with reference to the directions of the double-headed arrows shown in the drawings (front, rear, left, right, up and down, respectively).

The LED lighting apparatus 100 that is shown in FIG. 1 is provided with a translucent tube 101 (only a part of which is shown by two-dot chain lines in FIG. 1), a plurality of circuit boards CB (only two of which are partly shown in FIG. 1), LED units 102 and a plurality of connectors 10. The translucent tube 101 extends linearly in the forward/rearward direction. The plurality of circuit boards CB are arranged inside the translucent tube 101 to lie in a common plane and aligned in the forward/rearward direction. The LED units 102 are fixed to circuit formation surfaces formed on the undersurfaces of the plurality of circuit boards CB. Each connector 10 connects facing edges of adjacent circuit boards CB. Each LED unit 102 is provided with a base plate and an LED 103 integrally mounted thereon, and this base plate is connected (soldered) to a circuit (not shown) formed on the bottom (underside) of the associated circuit board CB.

Each connector 10 is provided with a pair of (front and rear) receptacle contacts 15 fixed to two circuit boards CB that are adjacent to each other, respectively, and a plug connector 30 which connects the pair of receptacle contacts 15.

First, the detailed structure of each receptacle contact 15 will be hereinafter discussed with reference to FIGS. 2 through 5.

Each receptacle contact 15 is formed from a thin base material made of a resilient copper alloy (e.g., phosphor bronze, beryllium copper or titanium copper) or a resilient Corson-copper alloy and formed into the shape shown in the drawings by being bent in the direction of thickness of the thin base material after press forming is performed thereon, and is firstly nickel plated, as a base plating, and is subsequently tin or gold plated, as a finish plating. Each receptacle contact 15 can be made by press forming on a plated metal base material.

Each receptacle contact 15 is rotationally symmetrical in shape (about a vertical axis passing through a center of a base 16 of the receptacle contact 15) and is provided with the aforementioned base 16, a pair of guide lugs (guide portions) 17, a pair of holding leaves (a first holding leaf 20 and a second holding leaf 23) and another pair of holding leaves (another first holding leaf 20 and another second holding leaf 23). The base 16 is in the shape of a substantially horizontal flat plate having a substantially rectangular shape in plan view. The pair of guide lugs 17 extend vertically downwards from the front and rear edges of the base 16, respectively. The front pair of holding leaves 20 and 23 project downwardly from left and right edges of the base 16, respectively, and the rear pair of holding leaves 20 and 23 project downwardly from right and left edges of the base 16, respectively.

Each guide lug 17 is provided on a lower surface thereof with a support groove 18 which is grooved upwardly, and the left and right inner surfaces of a lower part of the support groove 18 are flared downwardly and outwardly to be formed as a pair of guide surfaces 19, the distance of which therebetween increases in the downward direction.

The two first holding leaves (holding portions) 20, which extend downwards from a portion of the right edge of the base 16 in the vicinity of the rear end thereof and a portion of the left edge of the base 16 in the vicinity of the front end thereof, respectively, are each shaped into a substantially letter C in a front view (in cross section), and an engaging protrusion 21 having a hemispherical shape which is integrally formed with the first holding leaf 20 is provided on an inwardly-positioned surface of the outer surface of the first holding leaf 20. Each first holding leaf 20 is resiliently deformable in the leftward/rightward direction. Additionally, the base 16 is provided, on a portion of the left edge thereof in the vicinity of the fixed end of the left first holding leaf 20, with a notch which allows the left first holding leaf 20 to easily deform resiliently, and is further provided, on a portion of the right edge thereof in the vicinity of the fixed end of the right first holding leaf 20, with a notch which allows the right first holding leaf 20 to easily deform resiliently.

Figure 5:
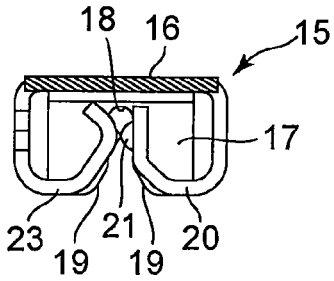
FIG. 5 is a cross sectional view taken along the V-V line shown in FIG. 4, viewed in the direction of the appended arrows.

The two second holding leaves (holding portions) 23, which are respectively formed at the front end of the right edge of the base 16 and the rear end of the left edge of the base 16, are each shaped into a substantially letter C in front view (in cross section); however, this letter C shape is slightly different from the shape of each first holding leaf 20 as shown in FIG. 5. Each second holding leaf 23 is provided, on an inwardly-positioned surface of the outer surface thereof at the same height as the engaging protrusions 21, with a holding protrusion 24 which is in the shape of a rectangular parallelepiped elongated in the forward/rearward direction and which is integrally formed with the second holding leaf 23. The end surface of each holding protrusion 24 is formed into a curved surface having a curvature radius of the order of 0.05 to 0.1 mm to be capable of receiving a concentrated load when contacting the associated plug contact 35. Similar to each first holding leaf 20, each second first holding leaf is resiliently deformable in the leftward/rightward direction. Additionally, the base 16 is provided, on a portion of the left edge thereof in the vicinity of the fixed end of the left second holding leaf 23, with a notch which makes the left second holding leaf 23 easy to deform resiliently, and is further provided, on a portion of the right edge thereof in the vicinity of the fixed end of the right second holding leaf 23, with a notch which makes the right second holding leaf 23 easy to deform resiliently.

The receptacle contacts 15 are installed to the circuit boards CB in advance outside of the translucent tube 101.

To install the receptacle contacts 15 to the aforementioned circuit formation surfaces of the circuit boards CB, the circuit formation surfaces of the circuit boards CB are placed face up, a pneumatic suction device (not shown) positioned above the circuit boards CB attracts the suction surface 25 of the base 16 of each receptacle contact 15 which is formed at a center of the undersurface of the base 16, subsequently each receptacle contact 15 thus held by the suction device is mounted on the circuit formation surface of the associated circuit board CB by moving the pneumatic suction device, and thereafter the suction device is retracted to be positioned above the receptacle contact 15. Thereafter, surface mounting technology (SMT) is used to solder each receptacle contact 15 to the aforementioned circuit that is formed on the associated circuit formation surface.

The detailed structure of the plug connector 30 of each connector 10 will be hereinafter discussed with reference to FIGS. 6 through 10.

The plug connector 30 of each connector 10 is provided with a plug contact 35 and a plug insulator 45.

The plug contact 35 is formed by press forming a thin base material made of a resilient copper alloy (e.g., phosphor bronze, beryllium copper or titanium copper) or a resilient Corson-copper alloy, and is firstly nickel plated, as a base plating, and is subsequently tin or gold plated, as a finish plating. The plug contact 35 can be made by press forming a plated metal base material. As shown in the drawings, the plug contact 35 is a plate-shaped member having a symmetrical shape in the forward/rearward direction, extends linearly in the forward/rearward direction and is resiliently deformable in the direction of thickness of the plug contact 35.

The plug contact 35 is provided, at upper edges of both ends thereof in the forward/rearward direction, with two engaging recesses 36, respectively. In addition, the plug contact 35 is provided in front and rear parts thereof with two (front and rear) contact portions 37, respectively, and is provided in each of the two contact portions 37 with a pair of connecting holes 38 formed as a pair of through-holes elongated and aligned in the forward/rearward direction.

A central portion of the plug contact 35 in the forward/rearward direction is formed as a central low-profile portion 39 which is smaller in height than the two contact portions 37, and a central portion of the central low-profile portion 39 constitutes a supported portion 40 of the plug contact 35 which lies on a straight line passing through the two contact portions 37.

In addition, the outer edge of the plug contact 35 is chamfered; specifically, the beveled upper edges of the two contact portions 37 serve as beveled guide surfaces for leading the plug contact 35 into the associated receptacle contacts 15.

The plug insulator 45 is an integrally-molded element which is molded of an insulating synthetic resin by injection molding. As shown in the drawings, the plug insulator 45 is in the shape of a box, the top of which is fully open. The plug insulator 45 is provided, in the internal space thereof in the front and rear of this internal space, with a pair of (front and rear) accommodation spaces 46, respectively.

The plug insulator 45 is provided, in a central portion thereof (the portion between the pair of accommodation spaces 46) in the lengthwise direction of the internal space of the plug insulator 45, with a pair of (left and right) center protuberances (supporting portion/holding portions) 48 which are formed integrally, and each of which is in the shape of a rectangular parallelepiped. Laterally facing surfaces of the left and right center protuberances 48, except for protrusions 48*a* whose cross section is a trapezoidal shape are formed at the center of the center protuberances 48 (see FIGS. 7, 8, 9, 12 and 13), are parallel surfaces (flat surfaces), orthogonal to the leftward/rightward direction, and the distance therebetween (in the leftward/rightward direction) is smaller than the width of each accommodation space 46 (the width thereof in the leftward/rightward direction) and greater than the plate thickness (dimension in the leftward/rightward direction) of the plug contact 35 (the supported portion 40 thereof). Laterally facing surfaces of the protrusions 48*a*, except for both the front and rear end portions of the protrusions 48*a* (slant surfaces of the trapezoid) in the front and rear directions, are parallel surfaces (flat surfaces), orthogonal to the leftward/rightward direction. A slit 49 is formed in each center protuberance 48 to be recessed downwardly from the upper surface thereof so that an inner portion of each center protuberance 48 that is positioned on the laterally inner side of the associated slit 49 can be resiliently deformed in the leftward/rightward direction. In addition, the plug insulator 45 is provided with left and right engaging lugs (supporting portion/holding portions) 50 which are integrally formed with the left and right center protuberances 48 to project from the upper edges of the aforementioned facing surfaces thereof toward each other, respectively. The distance between the laterally facing surfaces (edges)) of the left and right engaging lugs 50 (the distance therebetween in the leftward/rightward direction) in a free state thereof is slightly smaller than the plate thickness of the supported portion 40 of the plug contact 35. Additionally, the upper edges of the laterally facing inner ends of the left and right engaging lugs 50 are chamfered to serve as beveled guide surfaces 51 the distance therebetween decreases in the downward direction (see FIG. 8).

The plug insulator 45 is provided on inner surfaces of the front and rear walls thereof with two (front and rear) engaging projections (holding portions) 52 which are integrally formed with the plug insulator 45 to project inwardly from the inner surfaces of the front and rear walls of the plug insulator 45, respectively. Each of the front and rear engaging projections 52 is formed to create space (clearance) between a bottom (undersurface) of the associated accommodation space 46 (an upper surface of the bottom wall of the plug insulator 45) and left and right side walls of the plug insulator 45 adjacent to the engaging projection 52. As shown in the drawings, each engaging projection 52 is bilaterally symmetrical in shape and provided on top with a pair of (left and right) beveled surfaces. In addition, the spacing (distance in the vertical direction) between each engaging projection 52 (the bottom thereof) and the bottom of the associated accommodation space 46 is slightly greater than the height of each end (front and rear ends) of the plug contact 35 at which the engaging recesses 36 are formed, and the distance (in the leftward/rightward direction) between each engaging projection 52 and either of the left and right side walls of the plug insulator 45 adjacent to the engaging projection 52 is greater than the plate thickness of the plug contact 35.

Additionally, a pair of (left and right) limit projections 54 is provided in each of the front and rear accommodation spaces 46 of the plug insulator 45. As shown in the drawings, the distance (in the leftward/rightward direction) between the laterally facing surfaces of each pair of limit projections 54 (which face each other in the leftward/rightward direction) is substantially the same as the distance between the aforementioned laterally facing surfaces of the left and right center protuberances 48 except for the protrusions 48*a*. The laterally facing portions of each pair of limit projections 54, except for the top portions thereof, are each formed into a semi-cylindrical shape, and the top portions of the laterally facing portions of each pair of limit projections 54 are each shaped into a quarter-sphere (half a hemisphere).

Figure 6:
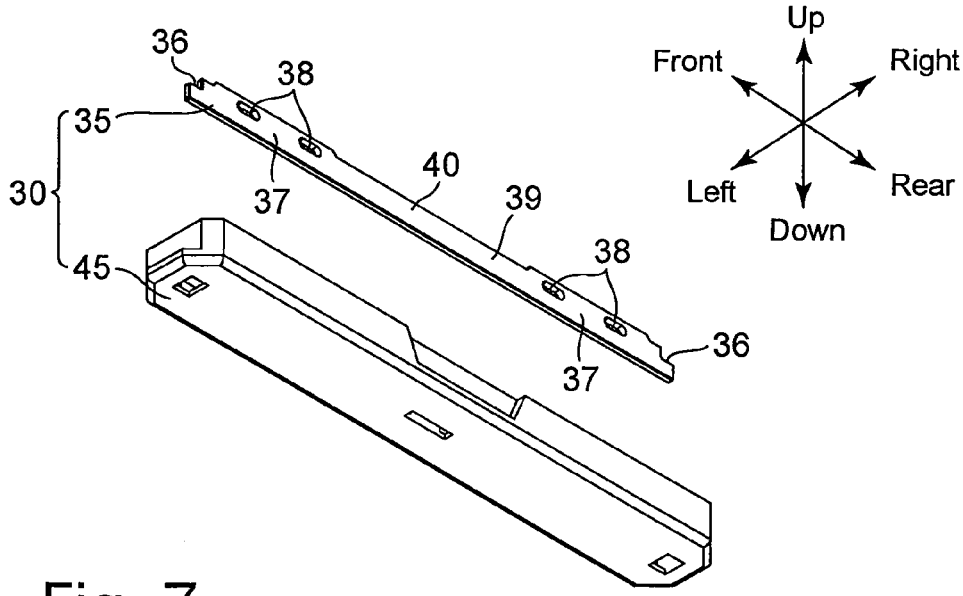
FIG. 6 is an exploded bottom perspective view of a plug connector shown in FIG. 1.
Figure 7:
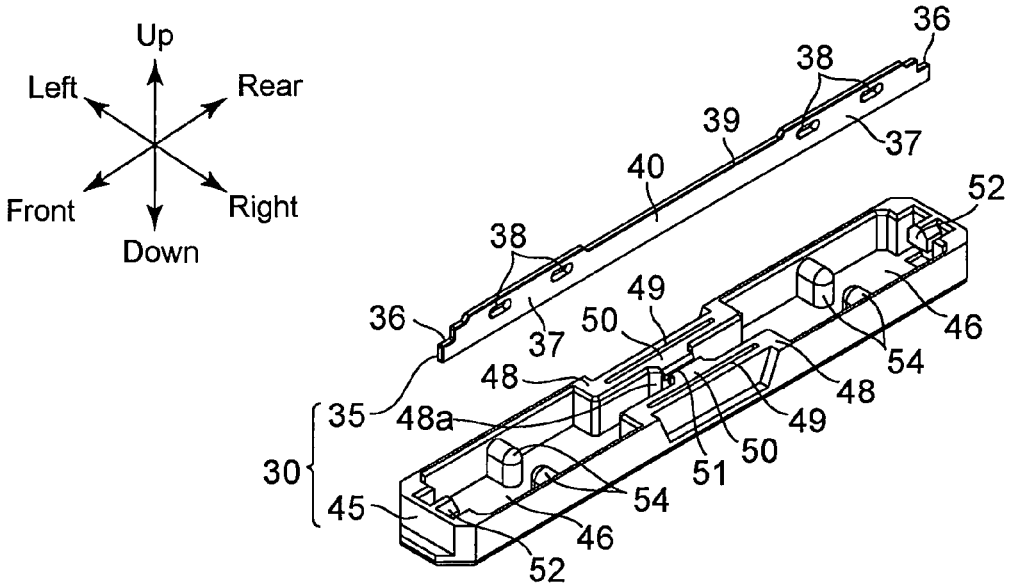
FIG. 7 is an exploded top perspective view of the plug connector.
Figure 8:
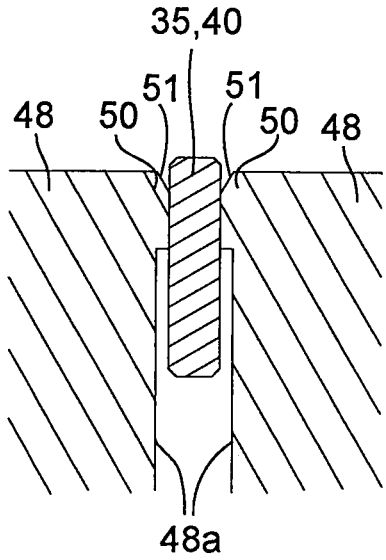
FIG. 8 is a cross sectional view of a portion of the plug connector, showing a state where a plug contact of the plug connector enters in between a pair of engaging lugs of the plug insulator of the plug connector while resiliently deforming the pair of engaging lugs.

To put the plug contact 35 and the plug insulator 45 together integrally into the plug connector 30, first the plug contact 35 is positioned immediately above the plug insulator 45 as shown in FIGS. 6 and 7. Subsequently, the plug contact 35 is made to be inclined with respect to a center line of the plug insulator 45 in plan view so that one end of the plug contact 35 in the lengthwise direction thereof is positioned immediately above the gap between one of the two engaging projections 52 and the left side wall of one end (front end) of the plug insulator 45 and so that the other end of the plug contact 35 in the lengthwise direction thereof is positioned immediately above the gap between the other engaging projection 52 and the right side wall of the other end (rear end) of the plug insulator 45.

Subsequently, with this inclined state maintained, both ends of the plug contact 35 are inserted into the aforementioned two gaps immediately below the engaging projections 52, respectively. Accordingly, a front part of the plug contact 35 comes in contact with the upper end of the left or right limit projection 54 on the front side while a rear part of the plug contact 35 comes in contact with the upper end of the right or left limit projection 54 on the rear side, respectively, and further insertion of both ends of the plug contact 35 into the aforementioned two gaps causes the aforementioned front and rear parts of the plug contact 35 to enter between the laterally facing surfaces of the front pair of limit projections 54 and between the laterally facing surfaces of the rear pair of limit projections 54 while being resiliently deformed toward the center line of the plug insulator 45 by the upper ends of the aforementioned limit projections 54, respectively (see the two-dot chain line shown in FIG. 10). Further insertion of both ends of the plug contact 35 into the aforementioned two gaps causes the supported portion 40 of the plug contact 35, which now extends substantially parallel to a straight line extending in the forward/rearward direction in plan view, to enter between the laterally facing engaging lugs 50 while sliding on (while being guided by) the beveled guide surface 51 of the left or right engaging lug 50. Thereupon, the supported portion 40 enters between the left and right center protuberances 48 (below the left and right engaging lugs 50) while resiliently deforming the left and right engaging lugs 50 in the opposite directions to widen the gap therebetween (see FIG. 8).

Figure 9:
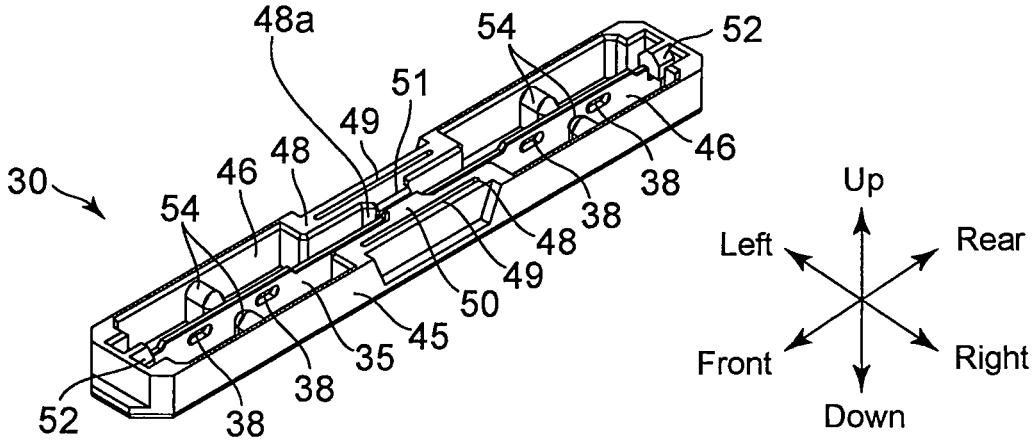
FIG. 9 is a top perspective view of the plug connector.
Figure 10:
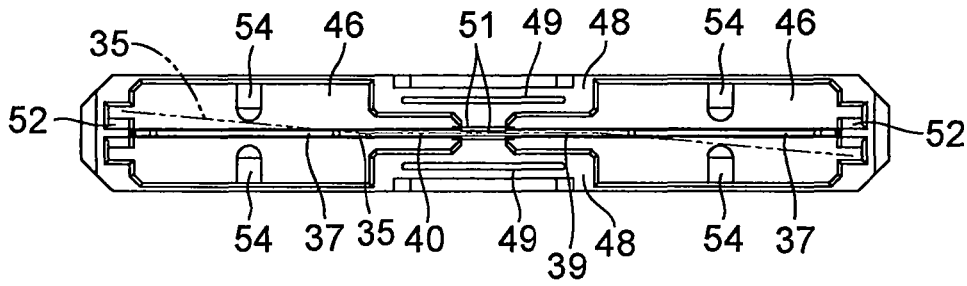
FIG. 10 is a plan view of the plug connector.
Figure 11:
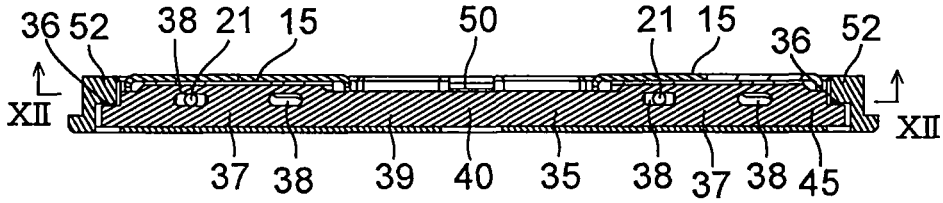
FIG. 11 is a longitudinal central sectional view of the plug connector and the receptacle contact when the plug connector and the receptacle contact are connected.

Subsequently, immediately after both the front and rear ends of the plug contact 35 respectively move to positions below the undersurfaces of the front and rear engaging projections 52 and the supported portion 40 of the plug contact 35 moves to a position below the undersurfaces of the left and right engaging lugs 50, the plug contact 35 resiliently returns to its free state (straight state) by its own resiliency, so that the front end of the plug contact 35 is positioned between the front engaging projection 52 and the bottom of the accommodation space 46 while the rear end of the plug contact 35 is positioned between the rear engaging projection 52 and the bottom of the accommodation space 46 (see FIGS. 9 and 10).

After the plug connector 30 is assembled in such a manner, a clearance is created between the pair of center protuberances 48 and the plug contact 35, between each pair of limit projections 54 and the plug contact 35, between the left side wall of the front end of the plug insulator 45 and the adjacent left side wall of the plug contact 35, between the right side wall of the front end of the plug insulator 45 and the adjacent right side wall of the plug contact 35, between the left side wall of the rear end of the plug insulator 45 and the adjacent left side wall of the plug contact 35 and between the right side wall of the rear end of the plug insulator 45 and the adjacent right side wall of the plug contact 35, so that the plug contact 35 is movable in the leftward/rightward direction relative to the plug insulator 45 by an amount corresponding to those clearances. In addition, the length of the internal space of the plug insulator 45 in the forward/rearward direction is greater than the length of the plug contact 35, and accordingly, the plug contact 35 is movable in the forward/rearward direction relative to the plug insulator 45 by an amount of clearance in the forward/rearward direction between the accommodation space and the plug contact 35. Additionally, the gap between the left and right engaging lugs 50 in a free state is smaller than the plate thickness of the plug contact 35 (the supported portion 40 thereof), and the plug contact 35 is required to be resiliently deformed largely if each of the front and rear ends of the plug contact 35 are to move into either of the two gaps on the laterally respective sides of the associated engaging projection 52. Therefore, there is no possibility of the plug contact 35 from coming off the plug insulator 45 unless the plug contact 35 is intentionally removed from the plug insulator 45. Namely, the plug contact 35 is held by the plug insulator 45 therein in a state of being allowed to move inside the plug insulator 45 with no load or stress being applied.

A procedure for connecting the circuit boards CB together using the connectors 10 (the receptacle contacts 15 and the plug connectors 30) will be discussed hereinafter.

The plurality of circuit boards CB are placed onto a fixing plate (not shown), which is formed into a thin plate elongated in the forward/rearward direction and has a plurality of female screw holes formed on the top surface, to be aligned in the forward/rearward direction with the undersurfaces thereof (surfaces opposite to the top surfaces that contain the LED units 102 and the receptacle contacts 15 thereon) facing down. Only two receptacle contacts 15 are fixed to the circuit board CB at the rear end thereof which is positioned at the front end of the array of the plurality of circuit boards CB, and only two receptacle contacts 15 are fixed to the circuit board CB at the front end thereof which is positioned at the rear end of the array of the plurality of circuit boards CB; however, two receptacle contacts 15 are fixed to each of the remaining circuit boards CB at each of the front and rear ends thereof, i.e., four receptacle contacts 15 in total are fixed to each of the remaining circuit boards CB.

Subsequently, set screws (not shown) are inserted into through-holes (not shown) formed through each circuit board CB to be screwed into associated female screw holes formed in the aforementioned fixing plate to thereby fix each circuit board CB to the fixing plate.

Subsequently, one plug connector 30 is positioned immediately above each pair of (front and rear) receptacle contacts 15 which face each other in the forward/rearward direction and are respectively fixed to the facing ends of two adjacent circuit boards CD, and thereafter each plug connector 30 is brought down (toward the circuit board CB) to the associated pair of receptacle contacts 15. Thereupon, as shown in FIGS. 1 and 11 through 15, a front part of the plug insulator 45 covers the front receptacle contact 15 so that the front receptacle contact 15 is positioned in the front accommodation space 46 while a rear part of the plug insulator 45 covers the rear receptacle contact 15 so that the rear receptacle contact 15 is positioned in the rear accommodation space 46.

Thereupon, the lower edges (upper edges with respect to FIGS. 1 and 6 through 9) of the front and rear contact portions 37 of the plug contact 35 come in contact with the guide surfaces 19 of the front receptacle contact 15 and the guide surfaces 19 of the rear receptacle contact 15, respectively, so that each contact portion 37 (of the plug contact 35) is guided toward the associated support grooves 18 (toward the center of the associated receptacle contact 15 in the widthwise direction thereof) by the associated guide surfaces 19. Subsequently, the front contact portion 37 of the plug contact 35 enters between the front pair of holding leaves 20 and 23 (between the engaging protrusion 21 and the holding protrusion 24) and between the rear pair of holding leaves 20 and 23 (between the engaging protrusion 21 and the holding protrusion 24) of the front receptacle contact 15 while the rear contact portion 37 of the plug contact 35 enters between the front pair of holding leaves 20 and 23 (between the engaging protrusion 21 and the holding protrusion 24) and between the rear pair of holding leaves 20 and 23 (the engaging protrusion 21 and the holding protrusion 24) of the rear receptacle contact 15. The distance between each engaging protrusion 21 and the adjacent holding protrusion 24 of each receptacle contact 15 in the leftward/rightward direction in a front view when in a free state is smaller than the plate thickness of the plug contact 35, so that each contact portion 37 of the plug contact 35 slides in between the associated pair of holding leaves 20 and 23 (the engaging protrusion 21 and the holding protrusion 24) while pressing (resiliently deforming) these holding leaves 20 and 23 in the opposite direction away from each other. Subsequently, upon each connecting hole 38 of the plug contact 35 reaching the same height as each engaging protrusion 21, each pair of holding leaves 20 and 23 slightly move toward each other to resiliently return to their original positions to be engaged in the associated connecting hole 38 with a tactile click. In addition, the holding protrusion 24 of each holding leaf 23 comes in contact with a side of the associated contact portion 37. Therefore, each receptacle contact 15 comes in contact with one contact portion 37 at four points.

Figure 12:
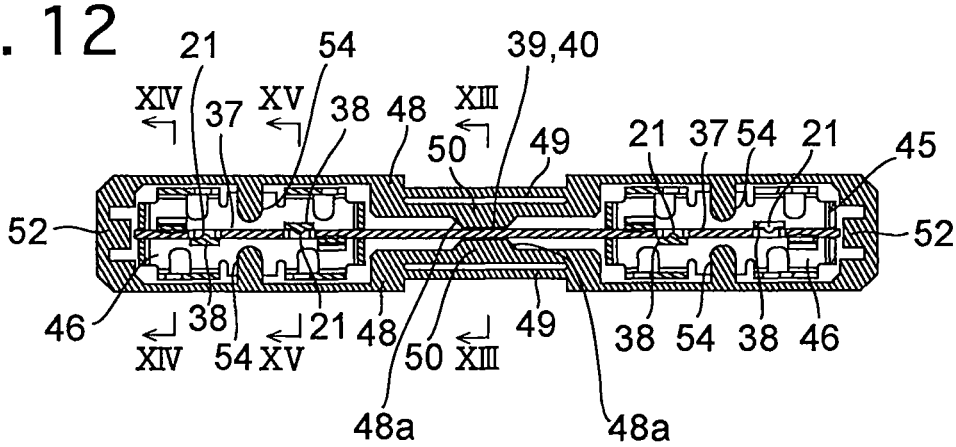
FIG. 12 is across sectional view taken along the XII-XII line shown in FIG. 11, viewed in the direction of the appended arrows.
Figure 13:
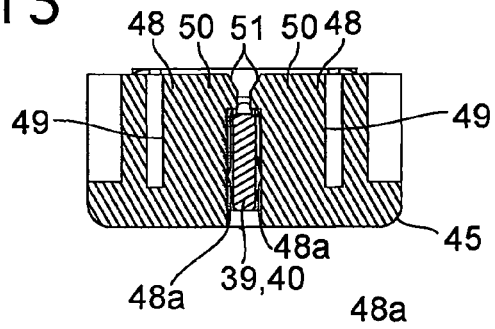
FIG. 13 is a cross sectional view taken along the XIII-XIII line shown in FIG. 12, viewed in the direction of the appended arrows.
Figure 14:
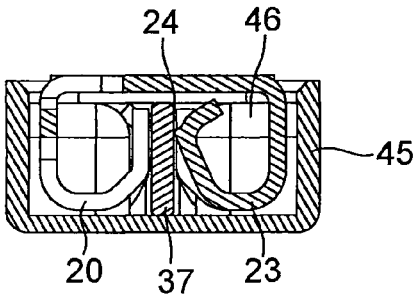
FIG. 14 is across sectional view taken along the XIV-XIV line shown in FIG. 12, viewed in the direction of the appended arrows.
Figure 15:
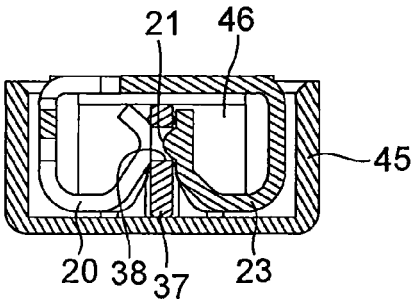
FIG. 15 is a cross sectional view taken along the XV-XV line shown in FIG. 12, viewed in the direction of the appended arrows.

Additionally, as shown in FIG. 12, since each limit projection 54 is positioned in the space between the front pair of holding leaves 20 and 23 and the rear pair of holding leaves 20 and 23 of the associated receptacle contact 15 (i.e., in the space immediately above the suction surface 25 of the associated receptacle contact 15), each limit projection 54 and the associated receptacle contact 15 do not interfere with each other.

Moreover, a force which holds the front and rear contact portions 37 of the plug contact 35 by engagement of the front and rear receptacle contacts 15 with the front and rear contact portions 37, respectively, is large, due to the plug contact 35 (the front and rear contact portions 37 thereof) being laterally held between the left and right engaging protrusions 21 and the right and left holding protrusions 24 of each receptacle contact 15 and due to each engaging protrusion 21 being engaged in the associated connecting hole 38 of the plug contact 35; and accordingly, the engaged state between the pair of receptacle contacts 15 and the plug contact 35 is not released unless the plug connector 30 is intentionally moved upwardly (downwardly with respect to FIG. 1).

In each connector 10, if the plug connector 30 is connected to the two receptacle contacts 15 so as to extend over the two receptacle contacts 15 in the above described manner, the front and rear contact portions 37 (the front pair of connecting holes 38 and the rear pair of connecting holes 38) come in contact with the front and rear receptacle contacts 15, respectively, via the engaging protrusions 21 and the holding protrusions 24, any two of the plurality of circuit boards CB adjacent to each other are electrically connected to each other via two receptacle contacts 15 and one plug contact 35. Therefore, if the aforementioned fixing plate on which the plurality of circuit boards CB and the connectors 10 are integrally mounted is inserted into the translucent tube 101 and a current is passed between the circuit boards CB positioned at both ends of the array of the plurality of circuit boards CB, the LEDs 103 of the LED units 102 that are contained on each circuit board CB emit light, which travels downwardly from the translucent tube 101.

Figure 16:
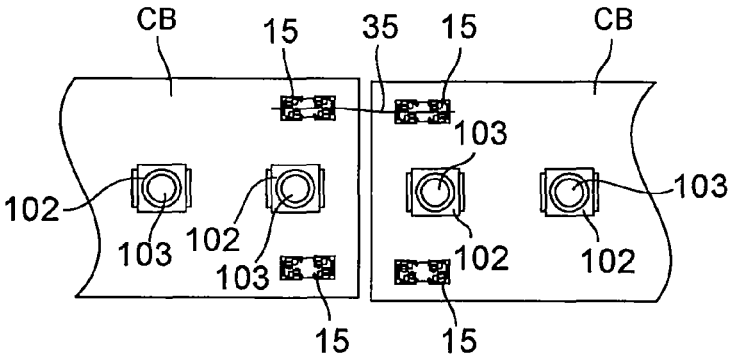
FIG. 16 is a bottom view of the portion of the straight tube LED lighting apparatus shown in FIG. 1 with the pair of plug insulators removed for clarity in a state where adjacent circuit boards deviate from each other in both the forward/rearward direction and the leftward/rightward direction.
Figure 17:
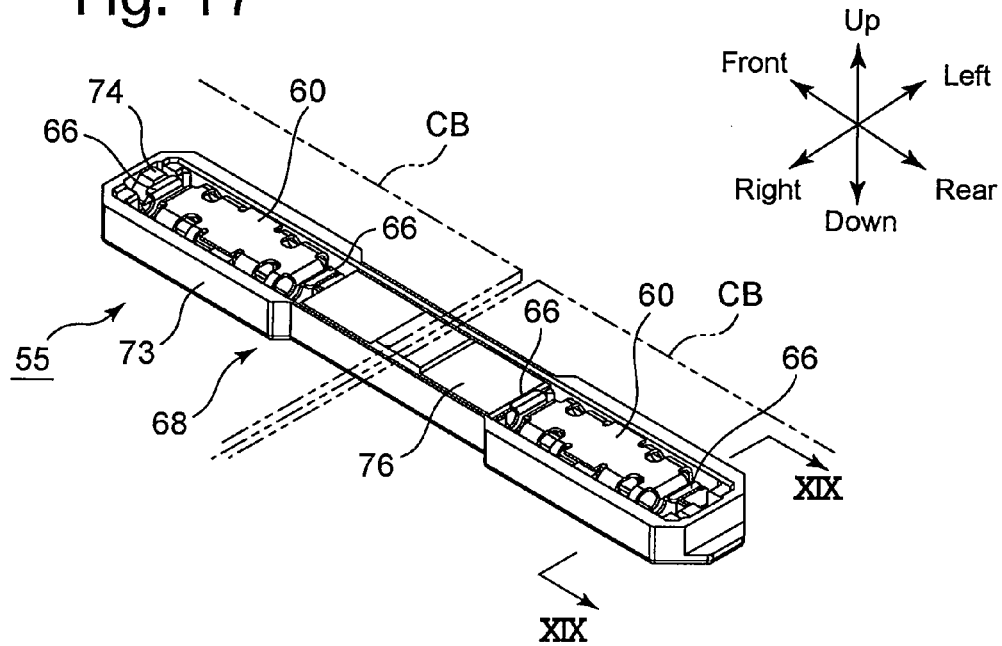
FIG. 17 is a top perspective view of a plug connector and two receptacle connectors of a second embodiment of the straight tube LED lighting apparatus according to the present invention in a state where the plug connector and the two receptacle connectors are in a connected state.
Figure 18:
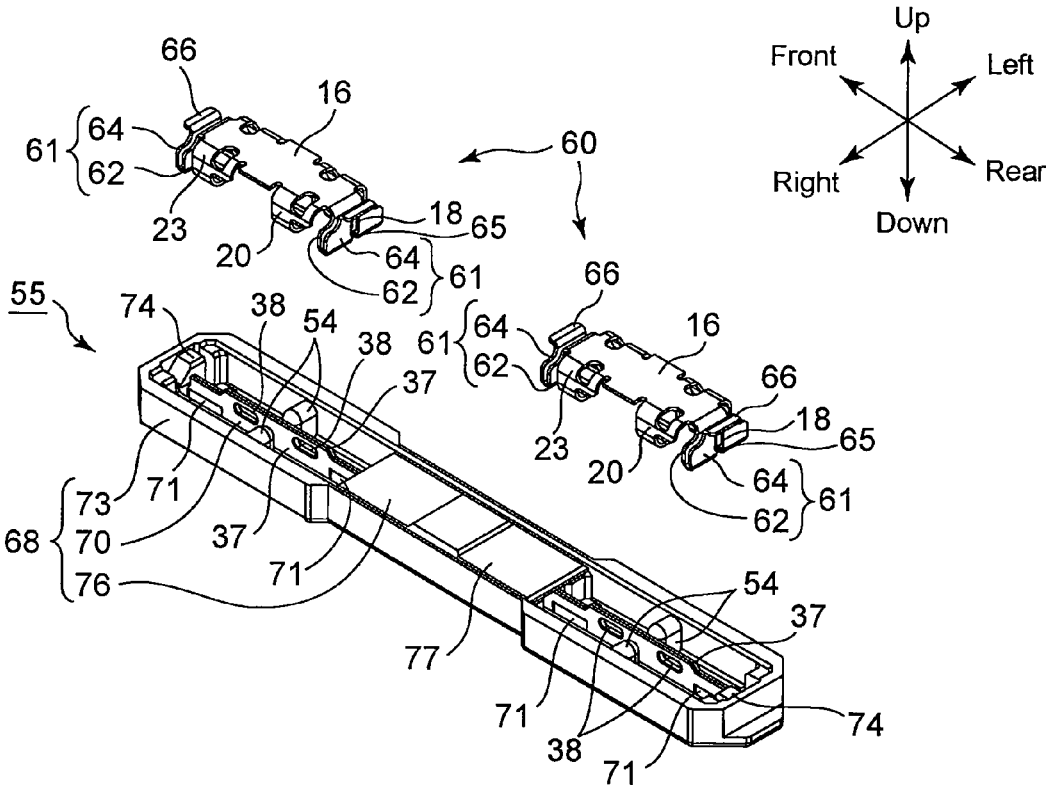
FIG. 18 is a top exploded perspective view of the plug connector and the two receptacle connectors shown in FIG. 17 in a disconnected state with the associated circuit boards removed for clarity.
Figure 19:
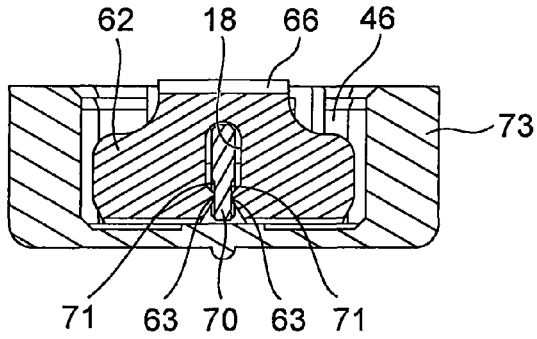
FIG. 19 is a cross sectional view taken along the XIX-XIX line shown in FIG. 17, viewed in the direction of the appended arrows.
Figure 20:
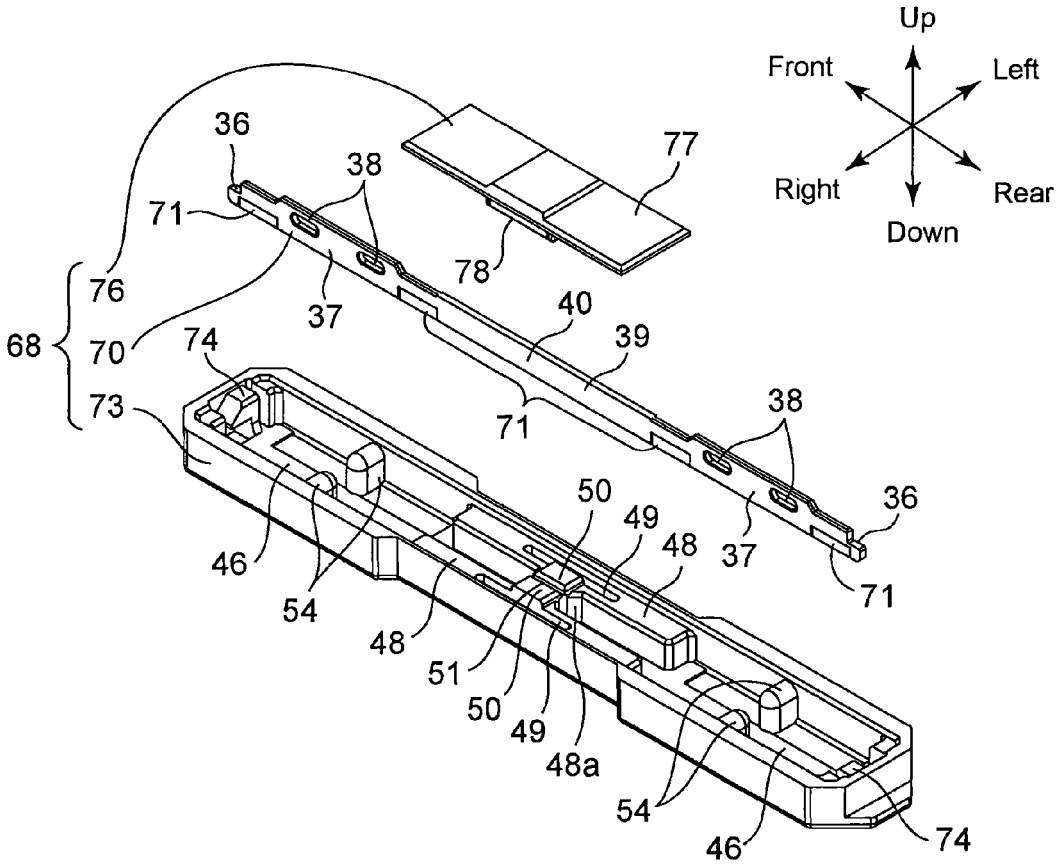
FIG. 20 is a top exploded perspective view of the plug connector of the second embodiment of the straight tube LED lighting apparatus.
Figure 21:
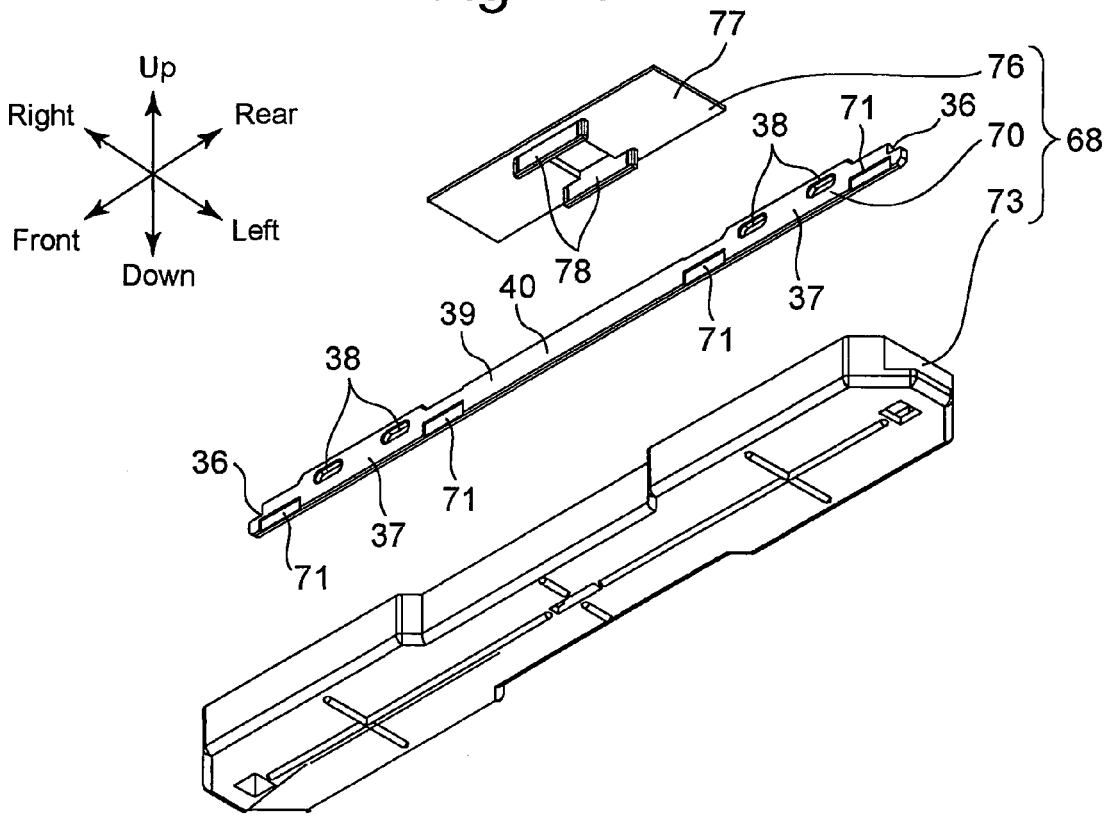
FIG. 21 is a bottom exploded perspective view of the plug connector of the second embodiment of the straight tube LED lighting apparatus.
Figure 22:
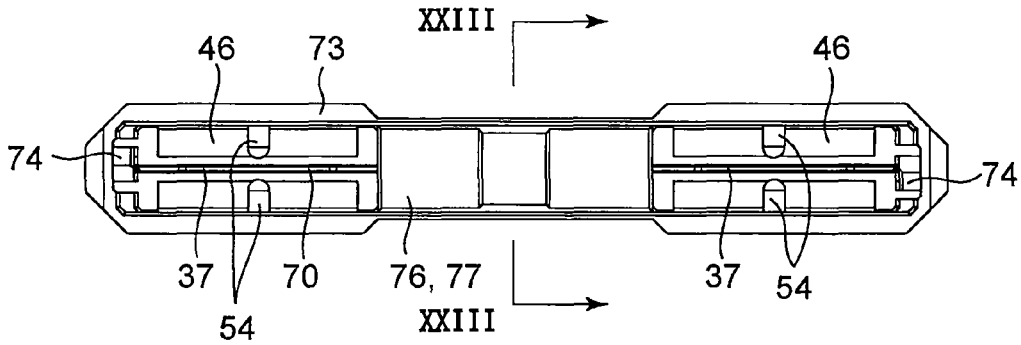
FIG. 22 is a plan view of the plug connector of the second embodiment of the straight tube LED lighting apparatus.
Figure 23:
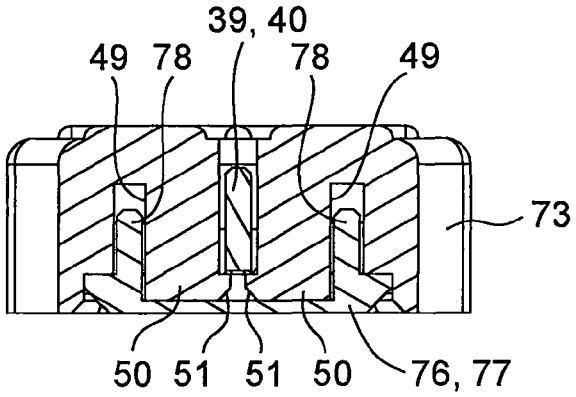
FIG. 23 is a cross sectional view taken along the XXIII-XXIII line shown in FIG. 22, viewed in the direction of the appended arrows.

If the position of formation of one or more of the aforementioned female screw holes (not shown) in the aforementioned fixing plate and/or the position of formation of one or more of the aforementioned through-holes (not shown) in each circuit board CB deviates from the design position in the leftward/rightward direction and/or the forward/rearward direction, a positional deviation occurs between adjacent circuit boards CB in the leftward/rightward direction and/or the forward/rearward direction as shown in FIG. 16. If such a positional deviation occurs, a force in the leftward/rightward direction and/or the forward/rearward direction is applied from each receptacle contact 15 to the associated plug contact 35 (the associated plug connector 30).

However, in each connector 10, if a force in the leftward/rightward direction is applied to the plug contact 35 from the support grooves 18 of either receptacle contact 15 due to a positional deviation between the associated two adjacent circuit boards CB in the leftward/rightward direction, the supported portion 40 of the plug contact 35 tilts between the left and right center protuberances 48 while being resiliently deformed in the leftward/rightward direction so that the front and rear contact portions 37 move in the leftward/rightward direction, thereby absorbing the aforementioned positional deviation between the associated two adjacent circuit boards CB in the leftward/rightward direction. Each connector 10 is structured so that it is difficult for each contact portion 37 of the plug contact 35 to tilt when the two receptacle contacts 15 and the plug contact 35 are connected together, since each contact portion 37 is guided by the two support grooves 18 of the associated receptacle contact 15 (the widths of the support grooves 18 of each receptacle contact 15 are slightly greater than the contact portions 37 of the plug contact 35). Therefore, even if a positional deviation between the associated two adjacent circuit boards CB in the leftward/rightward direction occurs, the effect on the engagement between each contact portion 37 and the associated engaging protrusion 21 and holding protrusion 24 due to the occurrence of the positional deviation is small. Accordingly, in this case also, adjacent circuit boards CB can be electrically connected to each other with reliability via the connectors 10.

Additionally, since the distance between each pair of limit projections 54 that face each other is greater than the distance between the laterally facing surfaces of the protrusions 48*a* (see FIGS. 7, 9, 12 and 13), each contact portion 37 can move by a greater amount than the supported portion 40 in the leftward/rightward direction in the plug insulator 45 of each plug connector 30, so that each connector 10 can flexibly cope with the positional deviation between adjacent circuit boards CB in the leftward/rightward direction even if the adjacent circuit boards CB deviate largely from each other in the leftward/rightward direction.

Additionally, since no part of the plug contact 35 is completely fixed (immovable), the plug contact 35 can disperse stress produced with a positional deviation between the associated two adjacent circuit boards CB.

The amount of positional deviation absorbable by the receptacle contacts 15 and the plug connector 30 of each connector 10 can be adjusted by adjusting the amount of clearance between the internal space of the plug insulator 45 and each receptacle contact 15.

In each connector 10, if a force in the forward/rearward direction is applied to the plug contact 35 from the engaging protrusions 21 or the holding protrusions 24 of the receptacle contacts 15 due to a positional deviation between the associated adjacent circuit boards CB in the forward/rearward direction, this positional deviation is absorbed by a sliding movement of each connecting hole 38 with respect to the associated engaging protrusion 21. Accordingly, in this case also, adjacent circuit boards CB can be electrically connected to each other with reliability via the connectors 10.

The plug contact 35 of each connector 10 is a plate-shaped member extending in one direction and provided with no projections like those of a conventional plug contact, which makes it possible to achieve a reduction in height of the plug contact 35 (as compared with a plug contact having one or more projections). This makes it possible to achieve a reduction in height of the plug connector 30 of each connector 10, and by extension a reduction in height of each connector 10. Consequently, the illumination range (illumination angle) of light which is emitted from the LEDs 103 while dispersing can be widened.

Additionally, the plug contact 35 of each connector 10 is structured such that the two contact portions 37 and the supported portion 40 are aligned, thus having a high mechanical strength against twisting and the like (as compared with a protrusion formed to protrude from a conventional plug contact body). Moreover, stress applied to the plug contact 35 due to a resilient deformation thereof can be effectively dispersed since the plug contact 35 has no bent portion. In addition, in each connector 10, each contact portion 37 (the connecting holes 38 formed therethrough) that forms part of the plug contact 35 is made to be in contact with (to be engaged with) the associated receptacle contact 15 (the first and second holding leaves 20 and 23 thereof), and accordingly, there is little possibility of the plug contact 35 (the contact portions 37 thereof) being distorted or damaged even if the front and rear contact portions 37 of the plug contact 35 and the front and rear receptacle contacts 15 are brought into contact (engagement) with each other, respectively, with a positional deviation therebetween. Therefore, the contact reliability between each plug contact 35 and the associated receptacle contacts 15 is high.

In each connector 10, the receptacle contacts 15 and the plug contact 35 are fully accommodated in the plug insulator 45, and the entire peripheries of the receptacle contacts 15 and the plug contact 35 are protected by the associated circuit boards CB and the plug insulator 45. With this structure, the plug contact 35 and the receptacle contacts 15 can be prevented from being damaged when the receptacle contacts 15 and the plug contact 35 are connected and also while in this connected state. Additionally, although the plug insulator 45 is provided in the bottom thereof with three holes (for the removal of a molding die(s) after molding; see FIG. 6) that are formed when the plug insulator 45 is molded, these holes are small and provided in the bottom of the plug insulator 45 when the LED lighting apparatus 100 is assembled, and accordingly, the possibility of sebum or foreign matter entering the inside of the plug insulator 45 through these holes and then adhering to the plug contact 35 or the receptacle contacts 15 is small, which makes it possible to prevent the occurrence of poor contacting, sparking or the like. Additionally, after the receptacle contacts 15 and the plug contact 35 are connected, the electrically conductive portions (e.g., the plug contact 35, the receptacle contacts 15, and mounting portions of the circuit boards CB) of each connector 10 are all covered, which makes it possible to increase the insulation performance to an extremely high level.

A second embodiment of the straight tube LED lighting apparatus according to the present invention will be hereinafter discussed with reference to FIGS. 17 through 24. Elements of this embodiment which are similar to or the same as those of the first embodiment of the LED lighting apparatus are designated by the same reference numerals, and a detailed description for such elements is omitted from the following description.

Each connector 55 that corresponds to each connector 10 of the previous embodiment is provided with a pair of (front and rear) receptacle contacts 60 fixed to two circuit boards CB adjacent to each other, respectively, and a plug connector 68 which connects the pair of receptacle contacts 60.

The basic structure of each receptacle contact 60 of the second embodiment is the same as that of each receptacle contact 15 of the first embodiment (similar to each receptacle contact 15, each receptacle contact 60 is rotationally symmetrical in shape about a vertical axis passing through a center of a base 16 of the receptacle contact 60); however, each receptacle contact 60 is different from each receptacle contact 15 in that each receptacle contact 60 is provided at both ends thereof in the forward/rearward direction with a front guide portion 61 and a rear guide portion 61, respectively. The front and rear guide portions 61 are each provided with a first guide leaf 62 and a second guide leaf 64. The first guide leaf 62 of the front guide portion 61 and the first guide leaf 62 of the rear guide portion 61 extend vertically downwards from the front and rear ends of the base 16, respectively, and the second guide leaf 64 of the front guide portion 61 and the second guide leaf 64 of the rear guide portion 61 are formed to extend vertically upwards by bending the lower ends of the first guide leaves 62. The first guide leaves 62 and the second guide leaves 64 of each receptacle contact 60 are each provided with a support groove 18 so that all the support grooves 18 extend upwardly and are aligned in the forward/leftward direction. Each first guide leaf 62 is provided, on left and right inner side surfaces in the associated support groove 18 in the vicinity of the lower end thereof, with a pair of inward lock projections 63 (see FIG. 19), respectively, which project inwardly toward each other, while each second guide leaf 64 is provided, on left and right inner side surfaces in the associated support groove 18 in the vicinity of the lower end thereof, with a pair of inward lock projections 65, respectively, which project inwardly toward each other (see FIG. 18). The distance in the left/right direction between the pair of inward lock projections 65 is slightly greater than the distance between the pair of inward lock projections 63. In addition, each guide portion 61 is provided with a tail lug 66 which projects from the upper end of the second guide leaf 64 to lie in a plane in which the associated base 16 lies.

Figure 24:
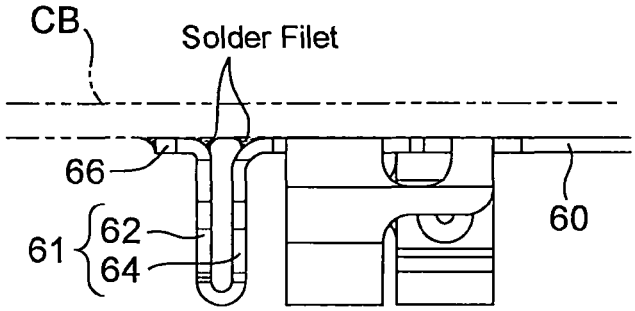
FIG. 24 is a side view of a receptacle contact of the second embodiment of the straight tube LED lighting apparatus.

Similar to the case of the receptacle contacts 15, the receptacle contacts 60 are soldered to the circuit formation surfaces of the circuit boards CB using a pneumatic suction device and surface mounting technology (SMT). At this time, as shown in FIG. 24, the front and rear tail lugs 66 of each receptacle contact 60 and the upper ends of the facing surfaces of the first guide leaf 62 and the second guide leaf 64 of each guide portion 61 are soldered (fixed) to the circuit formation surface of the associated circuit board CB.

The plug connector 68 of each connector 55 is provided with a plug contact 70, a plug insulator 73 and an insulating cover 76.

The basic structure of the plug contact 70 is the same as the basic structure of the plug contact 35 of each connector 10; namely, the plug contact 70 is provided with two engaging recesses 36, two contact portions 37, two pairs of connecting holes 38, a central low-profile portion 39 and a supported portion 40 (note that the functions of these elements 36 through 40 of the plug contact 70 are the same as those of the plug contact 35 of each connector 10 though slightly different in shape from those of the plug contact 35 of each connector 10). However, the plug contact 70 is further provided at four points on each of both sides (left and right sides) thereof with four lock recesses (lock portions) 71 each having a rectangular shape elongated in the forward/rearward direction as viewed from a side of the plug contact 70, and the lower end of each lock recess 71 reaches the lower edge of the plug contact 70 (namely, the lower end of each lock recess 71 is open downwardly). Although not shown in the drawings, the outer edge of each lock recess 71 is formed into a C-shaped surface (the shape of a letter C in cross section). Additionally, similar to the plug contact 35 of each connector 10, the outer edge of the plug contact 70 is chamfered.

The basic structure of the plug insulator 73 is the same as the basic structure of the plug insulator 45 of each connector 10; namely, the plug insulator 73 is provided with two accommodation spaces 46, two center protuberances 48, two slits 49, two engaging lugs 50 (beveled guide surfaces 51) and two limit projections 54 (note that the functions of these elements 46 through 54 of the plug insulator 73 are the same as those of the plug insulator 45 of each connector 10 though slightly different in shape from those of the plug insulator 45 of each connector 10).

The plug insulator 73 is provided on inner surfaces of the front and rear walls thereof with two (front and rear) engaging projections 74 which are integrally formed with the plug insulator 73 to project inwardly toward each other from the inner surfaces of the front and rear walls of the plug insulator 73, respectively. Each of the front and rear engaging projections 74 is formed to create a space (clearance) between a bottom (undersurface) of the associated accommodation space 46 (an upper surface of the bottom wall of the plug insulator 73) and left and right side walls of the plug insulators 73 adjacent to the engaging projection 74. The spacing (distance in the vertical direction) between each engaging projection 74 (the bottom thereof) and the bottom of the associated accommodation space 46 is slightly greater than the height of each of both ends (front and rear ends) of the plug contact 70 at which the engaging recesses 36 are formed, and the distance (in the leftward/rightward direction) between each engaging projection 74 and either of the aforementioned left and right side walls of the plug insulator 45 adjacent to the engaging projection 74 is greater than the plate thickness of the plug contact 70. However, the engaging projections 74 of the plug insulator 73 are different in shape from the engaging projections 52 of the plug insulator 45. Specifically, each of the front and rear engaging projections 74 of the plug insulator 73 is bilaterally asymmetrical in shape; the rear engaging projection 74 is provided on the top left thereof with a beveled surface and the front engaging projection 74 is provided on the top right thereof with a beveled surface.

The insulating cover 76 is an integrally-molded element which is molded from an insulating synthetic resin. The insulating cover 76 is provided with a substantially flat base plate portion 77, and a pair of (left and right) mounting lugs 78 which extends vertically downwards from the bottom of the base plate portion 77.

After integrating the plug contact 70 with the plug insulator 73 in a similar manner to the plug connector 30 of each connector 10, the plug connector 68 that has the above described structure can be assembled by installing the insulating cover 76 to a central part of the plug insulator 73 in the lengthwise direction thereof by making the left and right mounting lugs 78 of the insulating cover 76 engaged in the left and right slits 49 of the plug insulator 73 to be fixed thereto, respectively. Once the plug connector 68 is completely assembled, the left and right edges of the undersurface of the base plate portion 77 respectively come in contact with the upper surfaces of the left and right center protuberances 48, while the left and right side surfaces of the base plate portion 77 either come in contact with inner surfaces of the left and right side walls of the plug insulator 73 or face the inner surfaces with a minute clearance. Therefore, the central low-profile portion 39 (the supported portion 40) of the plug contact 70 is not exposed upwardly. In addition, the insulating cover 76 fixed in place is accommodated in the plug insulator 73, thus not projecting upwardly from the top of the plug insulator 73.

The plug connector 68 of the connector 55 can be connected to two receptacle contacts 60 which are respectively fixed to the facing ends of two circuit boards CB, adjacent to each other, so as to face each other in the forward/rearward direction in a similar connecting procedure to the first embodiment of the straight tube LED lighting apparatus. Upon the plug connector 68 being connected to the two receptacle contacts 60, the pairs of (left and right) inward lock projections 63 and the pairs of (left and right) inward lock projections 65 of the front receptacle contact 60 and the pairs of (left and right) inward lock projections 63 and the pairs of (left and right) inward lock projections 65 of the rear receptacle contact 60 are each engaged with (come in contact with) the associated lock recess 71 with a tactile click (see FIG. 19). Therefore, an incomplete connection can be prevented from occurring.

In each connector 55, if the two receptacle contacts 60 and the plug contact 70 are brought into engagement with each other with some positional deviation therebetween, heavy loads are exerted on the guide portions 61 of each receptacle contact 60; however, there is little possibility of the guide portions 61 of each receptacle contact 60 being distorted even if the two receptacle contacts 60 and the plug contact 70 are forced to be engaged with each other because the rigidities of the guide portions 61 are improved by soldering the front and rear tail lugs 66 of each receptacle contact 60 to the circuit formation surface of the associated circuit board CB and also because each guide portion 61 is configured of two guide leaves: the first guide leaf 62 and the second guide leaf 64. In addition, in each connector 55, even if an impactive force occurs between the receptacle contacts 60 and the plug contact 70 as a result of bringing the two receptacle contacts 60 and the plug contact 70 into engagement with each other at a relatively high speed, there is little possibility of the guide portions 61 of each receptacle contact 60 being distorted.

In addition, since each guide portion 61 is constructed from two leaves: the first guide leaf 62 and the second guide leaf 64, and since each pair of inward lock projections 63 and each pair of inward lock projections 65 are each engaged with the associated lock recess 71, the engaging and holding force between each receptacle contact 60 and the plug contact 70 of each connector 55 is greater than the engaging and holding force between each receptacle contact 15 and the plug contact 35 of each connector 10. Therefore, even in the case where the plug contact 70 of each plug connector 68 is connected to two adjacent receptacle contacts 60 so as to hang from these two adjacent receptacle contacts 60, the plug contact 70 does not come off the associated receptacle connectors 60 by its own weight or vibrations, so that adjacent circuit boards CB can be electrically connected to each other with reliability via the connectors 55.

Additionally, since the distance between the pair of inward lock projections 65 of each guide portion 61 of each receptacle contact 60 is slightly greater than the distance between the pair of inward lock projections 63 of each guide portion 61 of each receptacle contact 60, even if the plug contact 70 rotates (tilts in plan view) in the plug insulator 73 due to, e.g., a substantially large positional deviation between the associated two adjacent circuit boards CB in the leftward/rightward direction, since loads are not only applied to the second guide leaves 64 that are positioned on the outer sides of the first guide leaves 62, it is difficult for an excessive force to act on between each contact portion 37 (the connecting holes 38 formed therethrough) and the associated support grooves 18 (the associated inward lock projections 63 and 65).

The lower end of each guide portion 61 (at which the first guide leaf 62 and the second guide leaf 64 thereof are joined together) is curved (formed into the shape of a substantially letter U in cross section), and accordingly, each guide portion 61 can be prevented from being distorted or tilted because the plug contact 70 is engaged in the support grooves 18 of each receptacle contact 60 without getting caught or stuck when the plug contact 70 is brought into engagement with the support grooves 18 of each receptacle contact 60 while sliding on the lower ends of each guide portion 61.

As shown in FIG. 24, when the upper ends of the facing surfaces of the first guide leaf 62 and the second guide leaf 64 of each guide portion 61 are soldered to the circuit formation surfaces of the circuit boards CB, solder fillets (see blackened portions in FIG. 24) are formed thereon, which enhances the mounting strength of each receptacle contact 60 with respect to the associated circuit board CB.

Each lock recess 71 is greater in dimension (length) in the forward/rearward direction than each pair of inward lock projections 63 and each pair of inward lock projections 65 in the forward/rearward direction, and accordingly, in each connector 55 if a force in the forward/rearward direction is applied to the receptacle contact 60 and/or the plug contact 70 due to a positional deviation between the associated adjacent circuit boards CB in the forward/rearward direction, each pair of inward lock projections 63 and each pair of inward lock projections 65 retain the engagement with the associated lock recess 71 by slidingly moving therein in the forward/rearward direction with respect to the associated lock recess 71.

Additionally, since the plug connector 68 of each connector 55 is equipped with the insulating cover 76, reliable electrical isolation between the central low-profile portion 39 (the supported portion 40) of the plug contact 70 and the associated circuit board CB can be achieved. Since the isolating cover 76 is accommodated in the plug insulator 73, the isolating cover 76 and the associated circuit board CB do not interfere with each other, which makes it possible to achieve a reduction in height of the connector 55.

A third embodiment of the straight tube LED lighting apparatus according to the present invention will be hereinafter discussed with reference to FIGS. 25 through 30. Elements of this embodiment which are similar to those of the second embodiment of the LED lighting apparatus are designated by the same reference numerals, and a detailed description for such elements is omitted from the following description.

A connector 80 in this embodiment is for connecting a circuit board CBT which is positioned at either end of the array of circuit boards CB that are aligned in the forward/rearward direction (in FIG. 25 only the circuit board CBT positioned at the rear end of the array of circuit boards CB is shown) with an electric wire (connecting object) 99 used for supplying power to the circuit board CBT.

Figure 25:
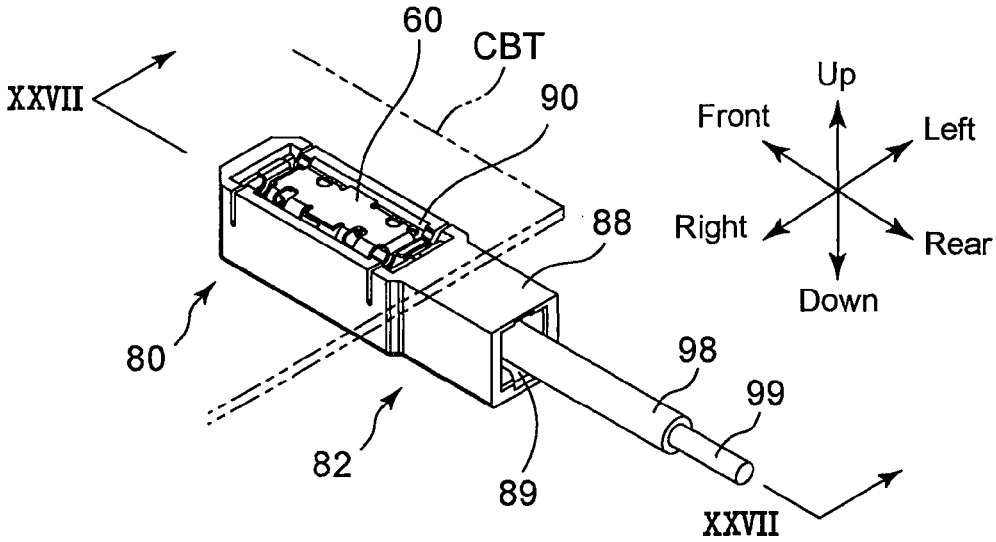
FIG. 25 is a top perspective view of a plug connector and a receptacle connector of a third embodiment of the straight tube LED lighting apparatus according to the present invention in a connected state.
Figure 26:
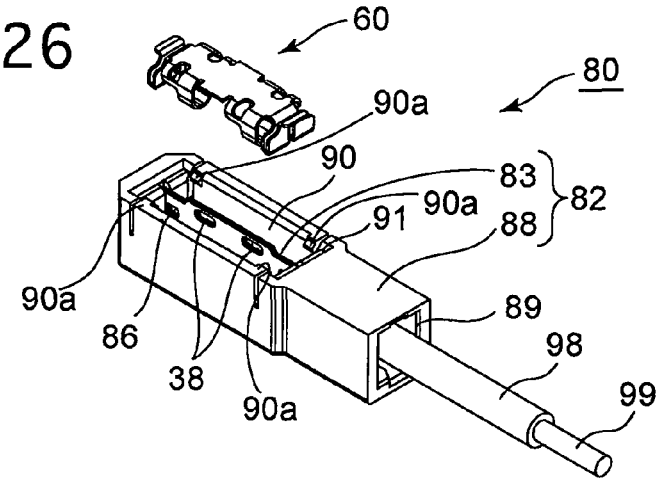
FIG. 26 is a top exploded perspective view of the plug connector and the receptacle connector shown in FIG. 25 in a disconnected state with the associated circuit boards removed for clarity.
Figure 27:
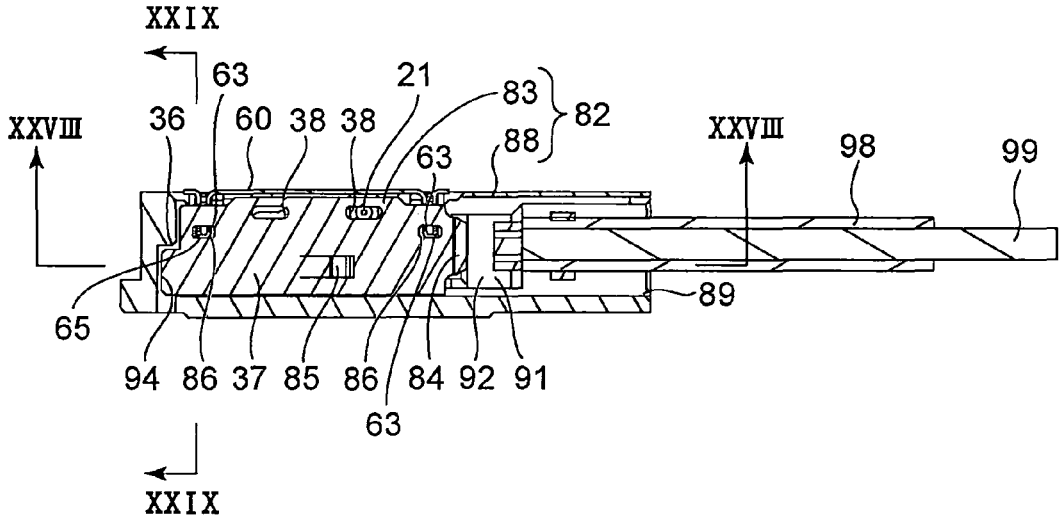
FIG. 27 is a cross sectional view taken along the XXVII-XXVII line shown in FIG. 25, viewed in the direction of the appended arrows.

In a similar procedure to the second embodiment of the straight tube LED lighting apparatus, a pair of (left and right) receptacle contacts 60 (only one of which is shown in FIG. 25) are fixed to the undersurface (circuit formation surface) of an end (partly shown by two-dot chain lines in FIG. 25) of the circuit board CBT in the forward/rearward direction which is on the opposite side of the circuit board CBT from the other end thereof that faces the adjacent circuit board CB (not shown in FIG. 25).

The connector 80 is provided with a receptacle contact 60 and a plug connector 82 which is composed of a plug contact 83 and a plug insulator 88.

The plug contact 83 is provided with an engaging recess 36, a contact portion 37 (having a pair of connecting holes 38), a wire connecting strip 84, a retaining lug 85 and a pair of lock-engaging holes 86 (lock portions) (note that the functions of the engaging recess 36, the contact portion 37 and the pair of connecting holes 38 are the same as those of the plug contact 70 of each connector 55 though slightly different in shape from those of the plug contact 70 of each connector 55). The engaging recess 36 of the plug contact 83 is formed at one end (the left end with respect to FIG. 27) of the plug contact 83. The wire connecting strip 84 projects rearwardly (the rightward with respect to FIG. 27) from the opposite end of the contact portion 37 from the engaging recess 36. The retaining lug 85 is formed at a substantially center of the contact portion 37 in the forward/rearward direction. The pair of lock-engaging holes 86 are formed as a pair of (front and rear) through-holes elongated in the forward/rearward direction, and the inner surfaces of both ends of each lock-engaging hole 86 are each formed into a C-shape in cross section.

The wire connecting strip 84 of the plug contact 83 is connected (by swaging) to a terminal of the electric wire 99 that is sheathed with a flexible outer sheath 98.

Figure 28:
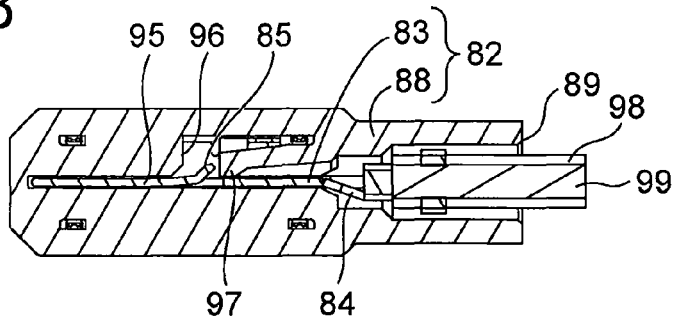
FIG. 28 is a cross sectional view taken along the XXVIII-XXVIII line shown in FIG. 27, viewed in the direction of the appended arrows.
Figure 29:
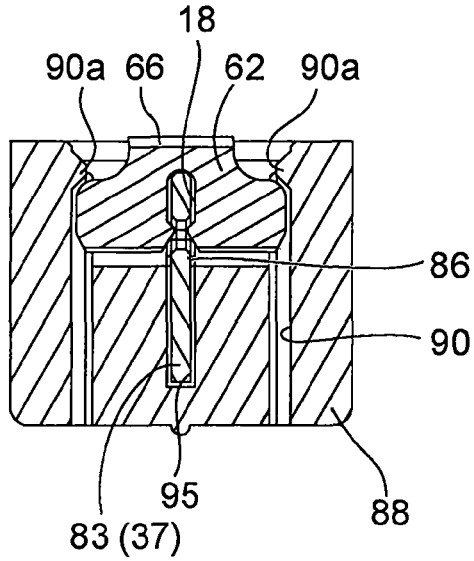
FIG. 29 is a cross sectional view taken along the XXIX-XXIX line shown in FIG. 27, viewed in the direction of the appended arrows.
Figure 30:
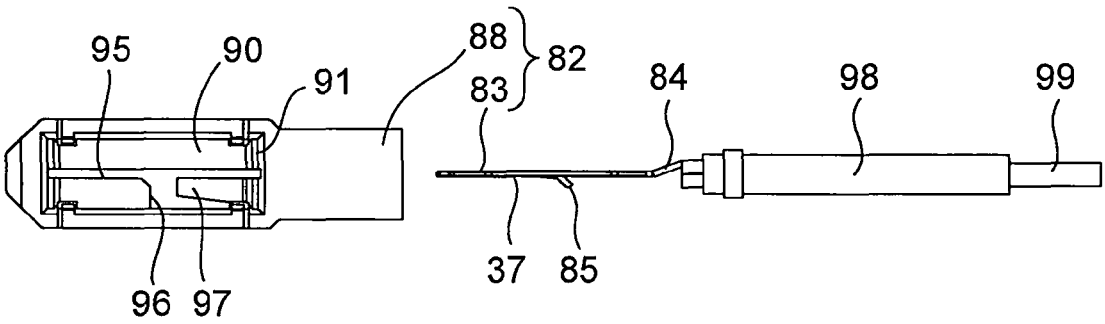
FIG. 30 is a plan view of a plug contact integrated with an electric wire and a plug insulator of the third embodiment of the straight tube LED lighting apparatus.

The plug insulator 88 is an integrally-molded element which is molded of the same insulating synthetic resin as that of the plug insulator 45 or 73. The plug insulator 88 is provided, at one end thereof in the lengthwise direction thereof, with an end opening 89 having a size allowing the outer sheath 98 (and the electric wire 99) which extends toward the other end of the plug insulator 88 to be inserted into and removed from the end opening 89. The top of the plug insulator 88 is recessed to form an accommodation space 90 in the plug insulator 88. In addition, the plug insulator 88 is provided therein with a partition wall 91 which partitions the inner end of the end opening 89 from the accommodation space 90, and the partition wall 91 is provided with a communicating hole 92 having a size (substantially the same width as the contact portion 37) that prevents the flexible outer sheath 98 (and the electric wire 99) from being inserted and allows the contact portion 37 to be removably inserted. The plug insulator 88 is provided, on an inner surface of the front end wall thereof in the accommodation space 90 which is positioned on the opposite side of the accommodation space 90 from the end opening 89, with a front end recess 94. The width (in the leftward/rightward direction) of the front end recess 94 is substantially the same as the wall thickness of the contact portion 37 (the engaging recess 36), and the front end recess 94 allows an engaging projection of the plug contact 83 which is formed immediately below the engaging recess 36 to be engaged therein. The plug insulator 88 is further provided, on a undersurface in the accommodation recess 90 and the inner surface of the front end wall (at which the front end recess 94 is provided), with an internal surface groove 95 in which a lower half of the contact portion 37 of the plug contact 83 is engageable. The width (in the leftward/rightward direction) of the internal surface groove 95 is substantially the same as the wall thickness of the contact portion 37. As shown in FIG. 28, the plug insulator 88 is provided, on a side surface thereof in a center part of the internal surface groove 95 in the lengthwise direction thereof (the forward/rearward direction), with an intermediate recess 96 which is recessed (upwards with respect to FIG. 28), and is further provided, on a portion of the plug insulator 88 adjacent to the intermediate recess 96 (on the end opening 89 side), with a retaining projection 97.

The plug contact 83, to which the electric wire 99 (and the outer sheath 98) is integrally fixed, is inserted into the accommodation space 90 through the end opening 89 and the communicating hole 92 to be integrated with the plug insulator 88 by fitting the aforementioned engaging projection (formed immediately below the engaging recess 36) and a lower half of the contact portion 37 into the front end recess 94 and the internal surface groove 95, respectively. Thereupon, the plug contact 83 is prevented from moving toward the end opening 89 by the engagement between the retaining lug 85 and the retaining projection 97, which are positioned inside the intermediate recess 96; however, since the plug contact 83 is not totally fixed by the plug insulator 88, stress applied to the plug contact 83 can be effectively dispersed.

The plug connector 82 is connected to the receptacle contact 60 contained on the circuit board CBT in a manner similar to that in the previous embodiment; namely, by covering the receptacle contact 60 from below with the plug insulator 88 so that the receptacle contact 60 enters the accommodation recess 90. Thereupon, each engaging protrusion 21 is engaged in the associated connecting hole 38 of the plug connector 82, each holding protrusion 24 comes in contact with a side surface of the contact portion 37, and the pairs of inward lock projections 63 and the pairs of inward lock projections 65 of the receptacle contact 60 are each engaged with (come in contact with) the associated lock-engaging hole 86. Additionally, a front pair of (left and right) engaging projections 90*a* formed in the accommodation space 90 on laterally facing inner surfaces of the plug insulator 88 are respectively engaged with upper left and right recess portions of each of the first guide leaf 62 and the second guide leaf 64 of the front guide portion 61 (see FIG. 29), and likewise, a rear pair of (left and right) engaging projections 90*a* (see FIG. 26) formed in the accommodation space 90 on laterally facing inner surfaces of the plug insulator 88 are respectively engaged with upper left and right recess portions of each of the first guide leaf 62 and the second guide leaf 64 of the rear guide portion 61. Therefore, the two circuit boards CBT at the opposite ends of the array of the plurality of circuit boards CB and the front and rear electric wires 99 are electrically connected via the front and rear connectors 80. Therefore, if a power supply (not shown) passes a current between the front and rear electric wires 99, the LEDs 103 of the LED units 102 that are contained on each circuit board CB and CBT emit light.

In addition, since each lock-engaging hole 86 is greater in length in the forward/rearward direction than each engaging projection 63 and 65, even if a sliding force in the forward/rearward direction acts on the plug contact 83 by, e.g., a twist of the associated electric wire 99 (the associated outer sheath 98), each pair of inward lock projections 63 and each pair of inward lock projections 65 retain the engagement with the associated lock-engaging hole 86 by slide movement of the plug contact 83 (the pair of lock-engaging holes 86) in the forward/rearward direction with respect to each pair of inward lock projections 63 and each pair of inward lock projections 65.

In addition, since each pair of inward lock projections 63 and each pair of inward lock projections 65 of each receptacle contact 60 are each engaged with (in contact with) the associated lock-engaging hole 86, a force in the downward direction (a force in a direction to make the plug contact 83 disengaged from the associated receptacle contact 60) acts on the plug contact 83 (the plug connector 82) by a twist of the associated electric wire 99 (the associated outer sheath 98), there is no possibility of the plug contact 83 coming off the associated receptacle contact 60.

In each connector 80, upon the plug connector 82 being connected to the receptacle contact 60, the pairs of (left and right) inward lock projections 63 and the pairs of (left and right) inward lock projections 65 of the receptacle contact 80 are each engaged with the associated lock-engaging hole 86 with a tactile click, so that incomplete connection can be prevented from occurring.

Additionally, since the plug contact 83 is greater in dimension (height) in the vertical direction than the plug contact 70 and therefore can secure a sufficient strength for the entire plug contact 83, the plug contact 83 is provided with the lock-engaging holes 86 as through-holes. However, no problem arises even if each lock-engaging hole 86 is formed as a recess (bottomed hole), rather than a through-hole.

Although the present invention has been described based on each of the above illustrated embodiments, the present invention is not limited solely to these particular embodiments; various modifications to the above illustrated embodiments are possible.

For instance, in each of the above illustrated first and second embodiments, the supported portion 40 of the plug contact 35 or 70 of each plug connector 30 or 68 can be made immovable with respect to the plug insulator 45 or 73 (the pair of center protuberances 48), e.g., by being fixed to the pair of center protuberances 48.

It is possible for a spring portion (resiliently deformable portion) that is resiliently deformable in the direction of thickness of the plug contact 35 or 70 to be formed at each end of the plug contact 35 or 70 and for each pair of holding leaves 20 and 23 that holds that spring portion to be each formed as a plate portion having no resiliency.

Additionally, the plug insulator 45 or 73 can be structured so that the plug contact 35 or 70 is supported only by the front and rear engaging projections 52 or 74 by, e.g., omitting the left and right engaging lugs 50.

Although each receptacle contact 15 or 60 is provided with two pairs of holding leaves 20 and 23 (the front pair of holding leaves 20 and 23 and the rear pair of holding leaves 20 and 23), it is possible that each receptacle contact 15 or 60 be provided with only one pair of holding leaves 20 and 23 or more than two pairs of holding leaves 20 and 23.

Additionally, each guide portion (17 or 61) of each receptacle contact 15 or 60 can be configured from more than two guide leaves.

In each of the above illustrated first through third embodiments, the reflectivity of the material of the plug insulator 45, 73 or 88 can be optimized, and the surface of the plug insulator 45, 73 or 88 can be coated with a non-light absorbing coating. This makes it possible to prevent the connector from absorbing the light of the LEDs 103.

Additionally, in the above illustrated first through third embodiments, each connector 10, 55 or 80 is applied to the LED lighting apparatus 100; however, the same connector can of course be applied to any other electric or electronic apparatus.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A connector comprising a plug connector and a receptacle connector which are disconnectably connected to each other to connect a circuit board and connecting object to each other in a manner to allow said circuit board and said connecting object to move relative to each other in one of a common plane, in which the circuit board and the connecting object both lie, and in mutually parallel planes, in which the circuit board and the connecting object respectively lie, wherein said receptacle connector comprises:

a receptacle contact which is fixed to one side of said circuit board, said receptacle contact including a pair of holding portions which are resiliently deformable in opposite directions away from each other, and a pair of guide portions which are spaced from each other with said pair of holding portions positioned therebewteen, wherein each guide portion of said pair of guide portions includes a support groove, wherein said plug connector comprises:

a plug contact which is electrically connected to said connecting object; and a plug insulator which holds said plug contact, wherein said plug contact is formed as a plate-shaped member which is linearly elongated in a direction parallel to said plane and resiliently deformable in a direction of thickness of said plate-shaped member, which is held between said pair of holding portions to be movable in said linearly elongated direction, and which includes a contact portion that is engaged in said support grooves of said pair of guide portions, and wherein said plug insulator includes an opening on a portion thereof facing said circuit board, and an accommodation space for accommodating said receptacle contact and said plug contact.

2. The connector according to claim 1, wherein said connecting object comprises another circuit board which lies in a plane in which said circuit board lies, said receptacle contact being fixed to one of both sides of said another circuit board, wherein said plug contact includes at least two said contact portions, one of which is held between said pair of holding portions and another of which is held between a pair of holding portions on said another circuit board; and a supported portion which lies on a straight line passing through said two contact portions, and wherein said plug insulator includes a support portion for supporting said supported portion to allow said supported portion to move in both said linearly elongated direction and said direction of thickness of said plate-shaped member.

3. The connector according to claim 1, wherein said connecting object comprises an electric wire which is connected to said plug contact.

4. The connector according to claim 1, wherein said each guide portion of said pair of guide portions comprises an engaging projection formed on an inner surface of said support groove, and wherein said plug contact comprises at least two lock portions with which said engaging projections of said pair of guide portions are engaged when said plug contact is engaged with said support grooves of said pair of guide portions, each of said lock portions being formed as one of a recess and through-hole.

5. The connector according to claim 1, wherein each of said pair of guide portions comprises at least two guide leaves which face each other in a lengthwise direction of said plug contact, and wherein said support groove is formed on each of said two guide leaves so that all of said support grooves are aligned in said lengthwise direction of said plug contact.

6. The connector according to claim 4, wherein each of said pair of guide portions comprises at least two guide leaves which face each other in a lengthwise direction of said plug contact, and wherein said engaging projection of each guide portion of said pair of guide portions comprises a pair of engaging projections which are respectively formed on both side surfaces on said support groove of at least one of said two guide leaves to be aligned in a direction of thickness of said plug contact.

7. The connector according to claim 5, wherein said receptacle contact comprises a base having a flat plate shape which is fixed to said circuit board, wherein each of said pair of guide portions comprises:

a first guide leaf which extends in a direction orthogonal to said base from an end of said base in said lengthwise direction of said plug contact; and a second guide leaf which extends from an end of said first guide leaf toward at least one of said circuit board and said another circuit board, and wherein a free end of said second guide leaf is soldered to one of said circuit board and said another circuit board.

8. The connector according to claim 6, wherein said receptacle contact comprises a base having a flat plate shape which is fixed to said circuit board, wherein each of said pair of guide portions comprises:

a first guide leaf which extends in a direction orthogonal to said base from an end of said base in said lengthwise direction of said plug contact; and a second guide leaf which extends from an end of said first guide leaf toward at least one of said circuit board and said another circuit board, and wherein a free end of said second guide leaf is soldered to one of said circuit board and said another circuit board.

9. The connector according to claim 1, wherein one of said pair of holding portions comprises an engaging protrusion; and wherein a connecting hole, in which said engaging protrusion is engaged to be movable relative to said connecting hole in said linearly elongated direction, is formed in said plug contact.

10. The connector according to claim 9, wherein the other of said pair of holding portions comprises a holding protrusion which contacts said plug contact.

11. The connector according to claim 2, wherein a moving range of each of said contact portions in said direction of thickness of said plate-shaped member in said accommodation space is wider than a moving range of said supported portion with respect to said support portion in said direction of thickness of said plate-shaped member.

12. An LED lighting apparatus comprising more than one said connector and more than one said circuit board according to claim 1, wherein at least one LED is provided on each said circuit board.

13. The connector according to claim 1, wherein said pair of holding portions are fixed at different positions in said linearly elongated direction.

* * * * *

UNITED STATES PATENT AND TRADEMARK OFFICE

CERTIFICATE OF CORRECTION

PATENT NO. : 8,475,000 B2
APPLICATION NO. : 13/188936
DATED : July 2, 2013
INVENTOR(S) : Hideharu Tamai It is certified that error appears in the above-identified patent and that said Letters Patent is hereby corrected as shown below:

Title Page, item [73] Assignee: should read as follows:

KYOCERA CONNECTOR PRODUCTS CORPORATION

Signed and Sealed this
Twenty-sixth Day of November, 2013

Margaret A. Focarino

Margaret A. Focarino
*Commissioner for Patents of the United States Patent and Trademark Office*